US006603466B1

(12) United States Patent
Sakaguchi et al.

(10) Patent No.: US 6,603,466 B1
(45) Date of Patent: Aug. 5, 2003

(54) SEMICONDUCTOR DEVICE AND DISPLAY DEVICE MODULE

(75) Inventors: Nobuhisa Sakaguchi, Tenri (JP); Yoshinori Ogawa, Yamatotakada (JP)

(73) Assignee: Sharp Kabushiki Kaisha, Osaka (JP)

( * ) Notice: Subject to any disclaimer, the term of this patent is extended or adjusted under 35 U.S.C. 154(b) by 260 days.

(21) Appl. No.: 09/598,953

(22) Filed: Jun. 22, 2000

(30) Foreign Application Priority Data

Nov. 9, 1999 (JP) ..... 11-318499
Feb. 29, 2000 (JP) ..... 2000-054711

(51) Int. Cl.[7] ..... G09G 3/36; G09G 5/00

(52) U.S. Cl. ..... 345/204; 345/88; 345/89; 345/95; 345/100

(58) Field of Search ..... 345/88, 89, 95, 345/100, 204, 685; 377/55; 362/341; 375/108; 324/770

(56) References Cited

U.S. PATENT DOCUMENTS 5,191,450 A * 3/1993 Yajima et al. ..... 345/88
5,465,053 A * 11/1995 Edwards ..... 324/770
5,641,225 A * 6/1997 Katoh et al. ..... 362/341
5,717,351 A * 2/1998 Katsutani ..... 327/108
5,757,353 A * 5/1998 Yokota et al. ..... 345/685
6,011,533 A * 1/2000 Aoki ..... 345/100

* cited by examiner

*Primary Examiner*—Bipin Shalwala
*Assistant Examiner*—Prabodh Dharia
(74) *Attorney, Agent, or Firm*—Birch, Stewart, Kolasch & Birch, LLP

(57) ABSTRACT

A semiconductor device includes source drivers connected in cascade, each of which is provided with a data latch output circuit for converting input display data into parallel data and a data output control circuit for converting the display data into serial data and outputting the serial data to the next source driver. The data latch output circuit divides and fetches the display data at both of the leading and trailing edges of a transfer-use clock signal of each source driver. With this structure, the clock frequency of the transfer-use clock signal can be made lower than a necessary data transfer rate of the display data while stabilizing the transfer of the display data. It is therefore possible to widen the operating frequency range of the transfer-use clock signal, and provide a highly reliable semiconductor device and a display device module using the semiconductor device.

18 Claims, 23 Drawing Sheets

SCKB

SCKA

SCKA 1

DISPLAY DATA
D INPUT
D1
D2
D3
D4
D5
D6
D7
D8

LEADING EDGE
SYNCHRONOUS DATA
OUTPUT OF DF/F 24a
D1
D5

LEADING EDGE
SYNCHRONOUS DATA
OUTPUT OF DF/F 24c
D2
D6

TRAILING EDGE
SYNCHRONOUS DATA
OUTPUT OF DF/F 24b
D3
D7

TRAILING EDGE
SYNCHRONOUS DATA
OUTPUT OF DF/F 24d
D4
D8

DISPLAY DATA
D OUTPUT
D1
D2
D3
D4
D5
D6
D7
D8

SCKB
OUTPUT

SCKA
OUTPUT

SEMICONDUCTOR DEVICE AND DISPLAY DEVICE MODULE

FIELD OF THE INVENTION

The present invention relates to a semiconductor device composed of a plurality of semiconductor processing sections connected in cascade, and also relates to a display device module using the semiconductor device.

BACKGROUND OF THE INVENTION

FIG. 20 illustrates the system structure of semiconductor processing sections in a conventional liquid crystal display device module. As shown in FIG. 20, a plurality of source drivers 51 and gate drivers 52 made of LSIs (large scale integrated circuits) are mounted as source drivers S and gate drivers G, respectively, on a liquid crystal panel 54 in such a state in which they are incorporated in TCPS (tape carrier packages). These source drivers S drive source buslines (not shown) in the liquid crystal panel 54, while the gate drivers G drive gate buslines (not shown) therein.

Terminals (a group of terminals) of each of the source drivers 51 and gate drivers 52, which are located on the liquid crystal panel 54 side, are electrically connected to a terminal (not shown) formed by an ITO (indium tin oxide) on the liquid crystal panel 54 through the lines in the TCPs 53. For instance, electrical connection of the terminals is achieved by thermo-compression bonding with an ACF (anisotropic conductive film) therebetween. Moreover, terminals of each of the source drivers 51 and gate drivers 52, which are located on a flexible substrate 55 side, are electrically connected to the lines on the flexible substrate 55 through the lines in the TCPs 53 by the above-mentioned ACF or soldering.

Therefore, supply of display-use data signals to the source drivers 51 from a controller circuit 56 and supply of various control signals and power (GND, Vcc) to the source drivers 51 and the gate drivers 52 are performed through the lines on the flexible substrate 55 and the lines on the TCPs 53.

Here, for the source drivers S, a total of eight source drivers, i.e., the first source driver S(1) to the eighth source driver S(8), are provided. Meanwhile, for the gate drivers G, a total of two gate drivers, i.e., the first gate driver G(1) and the second gate driver G(2), are provided.

Regarding the first source driver S(1) to the eighth source driver S(8), eight identical source drivers 51 are connected in cascade to supply the display-use data signals R, G, B, a start pulse input signal SSPI and a clock signal SCK output from the controller circuit 56.

Besides, regarding the first gate driver G(1) and the second gate driver G(2), two identical gate drivers 52 are connected in cascade to supply a clock signal GCK and a start pulse input signal GSPI output from the controller circuit 56. FIG. 21 is an enlarged view of the structure of the terminals of the controller circuit 56 that output various signals.

The number of pixels in the liquid crystal panel 54 is, for example, 1024 pixels×3 (RGB) [on the source side]×768 pixels [on the gate side]. Therefore, each of the source drivers 51 of the first source driver S(1) to the eighth source driver S(8) displays 64 gray scales, and drives 128 pixels×3 (RGB).

FIG. 22 shows the structure of the source driver 51. As illustrated in FIG. 22, the source driver 51 includes a shift register circuit 61, a data latch circuit 62, a sampling memory circuit 63, a hold memory circuit 64, a reference voltage generator circuit 65, a DA converter circuit 66, and an output circuit 67.

The shift register circuit 61 includes, for example, a plurality of latch circuits (not shown) connected in cascade. For the explanation of the operation, assuming that this source driver 51 is referred to as the first source driver (1) of the first stage, the shift register circuit 61 shifts (transmits/transfers) the start pulse input signal SSPI, which was synchronized with a horizontal synchronizing signal of the display-use data signals R, G, B, output from the terminal SSPI of the controller circuit 56 and input to the input terminal SSPin of the source driver 51, by the clock signal SCK which was output from the terminal SCK of the controller circuit 56 and input to the input terminal SCKin of the source driver 51.

The start pulse input signal SSPI shifted by the shift register circuit 61 is output from the output terminal SSPout of the source driver 51 so that the output of the final stage is output as the start pulse output signal SSPO, and then input as the start pulse input signal SSPI to the input terminal SSPin of the source driver 51 of the second source driver S(2) of the next stage. In this manner, the start pulse input signal SSPI is shifted up to the final stage of the shift register circuit 61 of the source driver 51 of the eighth source driver S(8) of the eighth stage.

Moreover, the clock signal SCK input to the shift register circuit 61 is also output from the output terminal SCKout of the source driver 51, input to the input terminal SCKin of the source driver 51 of the second source driver S(2) of the next stage, and transferred up to the source driver 51 of the eighth source driver S(8).

On the other hand, 6-bit display-use data signals R, G, B output from the terminals R1 to R6, G1 to G6 and B1 to B6 of the controller circuit 56 are synchronized with the rise of a clock signal/SCK (the inverted signal of the clock signal SCK), serially input to the input terminals R1in to R6in, G1in to G6in and B1in to B6in of the source driver 51, respectively, temporarily latched by the data latch circuit 62 and then forwarded to the sampling memory circuit 63.

Furthermore, the display-use data signals R, G, B which were serially input to the input terminals R1in to R6in, G1in to G6in and B1in to B6in of the source driver 51 are output from the output terminals R1out to R6out, G1out to G6out and B1out to B6out of this source driver 51, respectively, and forwarded to the source driver 51 of the second source driver S(2) of the next stage. In the same manner they are successively transferred up to the source driver 51 of the eighth source driver S(8).

The sampling memory circuit 63 samples display-use data signals (a total of 18 bits, i.e., 6 bits for each of R, G, B) sent by time division with the output signal of each stage of the shift register circuit 61, and stores them until a latch signal LS output from the terminal LS of the controller circuit 56 is input to the terminal LS of the source driver 51.

These display-use data signals are then input to the hold memory circuit 64 where the display-use data signals input from the sampling memory circuit 63 are latched by the latch signal LS upon the input of the display-use data signals corresponding to one horizontal period of the display-use data signals R, G, B, held until the display-use data signals corresponding to the next horizontal period are input to the hold memory circuit 64 from the sampling memory circuit 63 and then output.

The reference voltage generator circuit 65 generates 64 levels voltages used for, for example, gray-scale display by resister division from reference voltages which are output from the terminals Vref1 to Vref9 of the controller circuit 56 and input to the terminals Vref1 to Vref9 of the source driver 51.

The DA converter 66 converts each of the 6-bit display-use data signals (digital) R, G, B input from the hold memory circuit 64 into an analog signal, and outputs the resultant signal to the output circuit 67. The output circuit 67 amplifies 64 levels analog signals, and outputs them to the terminal (not shown) of the liquid crystal panel 54 from the output terminals Xo-1 to Xo-128, Yo-1 to Yo-128 and Zo-1 to Zo-128. The output terminals Xo-1 to Xo-128, Yo-1 to Yo-128 and Zo-1 to Zo-128 correspond to the display-use data signals R, G, B, respectively. Each of the Xo, Yo and Zo includes 128 terminals.

The terminal Vcc and the terminal GND of the source driver 51 are power-supply terminals connected to the terminal Vcc and terminal GND of the controller circuit 56, and supplied with a power supply voltage and grand potential. Note that, each of the buffer circuits provided in the input section and output section of the source driver 51 are omitted in FIG. 22.

The above descriptions explain the structure and operation of a group of source drivers S for 64-gray-scale display. Regarding the gate driver 52 constituting the gate driver G, since it has basically the same structure as the source driver 51 of the source driver S, the explanation thereof will be omitted here.

By the way, nowadays, there is a tendency to increase the number of pixels and the resolution of the liquid crystal display device modules. For the increases of the number of pixels and the resolution, the source drivers 51 and gate drivers 52 need to increase the data transfer rate of the display-use data signals R, G, B, i.e., to perform the operations with a high-frequency clock. This is particularly apparent for the source drivers 51 in comparison with the gate drivers 52.

However, the source drivers 51 as the semiconductor processing sections employed in the above-described conventional liquid crystal display module suffer from the following problem and can not sufficiently satisfy the need for the increases of the number of pixels and the resolution.

More specifically, in the above-described conventional liquid crystal display module, a plurality of identical source drivers 51 are used by connecting them in cascade, and the display-use data signals R, G, B are input only to the source driver 51 of the first source driver S(1) of the first stage. Meanwhile, the respective source drivers 51 of the other source drivers S located after the first source driver S(1) employ a self-transfer system which successively transfers the display-use data signals R, G, B through the source drivers 51.

In this case, for example, in the source driver S for displaying 64 gray scales, a very high data transfer rate of 65 MHz is needed for an XGA (1024×RGB×768) panel which handles a total of 18 data (6 bits×three kinds: R, G, B) corresponding to R, G, B. Furthermore, a higher transfer rate of 95 MHz is required for a high-definition SXGA (1280×RGB×1024) panel. It is thus necessary to successively self-transfer the display-use data signals at a higher data transfer rate as the definition is increased.

However, in order to ensure the specifications (data setup/hold time) for the data fetching timing in the source driver S of the next stage by the same transfer-use clock signal SCK, it is necessary to fetch the next display-use data signals within a cycle of the clock signal SCK as shown in FIG. 23. However, in the case where the signals are self-transferred at a higher rate, they are easily affected by the capacity of the line, etc., and hence it is difficult to ensure the specifications for the data fetching timing and the image quality of high-definition display may deteriorate.

Furthermore, with the conventional technique, in the case where the signals are self-transferred at a higher data transfer rate, it is difficult ensure the duty ratio (the ratio between a high period and a low period) of the transfer-use clock signal SCK in the source driver S, and hence the operating frequency may decrease and the image quality of high-definition display may deteriorate.

SUMMARY OF THE INVENTION

Considering the above problems, it is an object of the present invention to widen the operating frequency range of the clock signal SCK and provide a semiconductor device capable of realizing a display image of highly reliable image quality and a display device module using the semiconductor device.

In order to achieve the above object, a semiconductor device of the present invention includes:

a plurality of semiconductor processing sections which are connected in cascade and perform data processing by a self-transfer system in which a plurality of signals input to the semiconductor processing section of the first stage are successively transferred through the semiconductor processing section to other semiconductor processing section;

dividing means, provided in an input section of each of the semiconductor processing sections, for converting serial data to be transferred into parallel data by dividing the serial data of one channel into N channels (N is a natural number) by using both of the leading and trailing edges of a first clock signal as data fetching timing; and synthesizing means, provided in an output section of each of the semiconductor processing sections, for synthesizing the one-channel serial data from the divided N-channel parallel data. In the above semiconductor device, N is preferably 2 or 4 to facilitate the fabrication of the semiconductor processing sections.

With this structure, in each of the semiconductor processing sections, the serial data as one-channel display-use data signals is divided into N channels, for example, 2 or 4-channel parallel data by fetching the serial data at both of the leading and trailing edges of the first clock signal by the dividing means provided in the input section. For instance, the parallel data is used for display. In the synthesizing means provided in the output section, the one-channel serial data is synthesized again from the parallel data, i.e., the parallel data is brought back into the serial data, and the serial data is output. Thus, the signals are transferred between the semiconductor processing sections by the self-transfer system.

In this structure, therefore, the frequency of the first clock signal can be reduced to 1/N of the data transfer rate (data frequency) of the serial data, for example, reduced to a half for 2 channels. Additionally, in the above structure, with the reduction of the frequency of the first clock signal, the transfer timing of the display-use data signals to be successively transferred to the semiconductor processing section of the next stage can be controlled, for example, delayed by the synthesizing means, and hence the specifications (data setup/hold time) for the data fetching timing of the display-use data signals can be easily ensured in each of the semiconductor processing sections.

Consequently, according to the above structure, for example, even when the semiconductor device is incorporated as a drive device for a liquid crystal display device into a liquid crystal display device module and the data frequency of the serial data such as the display-use data signals is increased to achieve a high-definition liquid crystal display device module, the duty ratio of the transfer-use first clock signal can be ensured in each semiconductor processing section without causing problems and the specifications for the data fetching timing can be easily ensured, thereby achieving a display image of highly reliable quality with the widening of the operating frequency range of the clock signal and the decrease of the operating frequency of the clock signal.

In order to achieve the above object, a display device module of the present invention includes any one of the semiconductor devices and a display section driven by the semiconductor device. In this display device module, the display section may be a liquid crystal display section.

According to this structure, since the semiconductor processing section can certainly meet a higher (faster) data frequency of the display-use data signals to achieve a high definition, the quality of the display image on the display section, for example, the liquid crystal display section, using the display-use data signals can be improved in a stable manner while ensuring high definition.

For a fuller understanding of the nature and advantages of the invention, reference should be made to the ensuing detailed description taken in conjunction with the accompanying drawings.

DESCRIPTION OF THE PREFERRED EMBODIMENTS

Embodiment 1

The following description will explain one embodiment of the present invention with reference to FIGS. 1 to 5.

Figure 2:
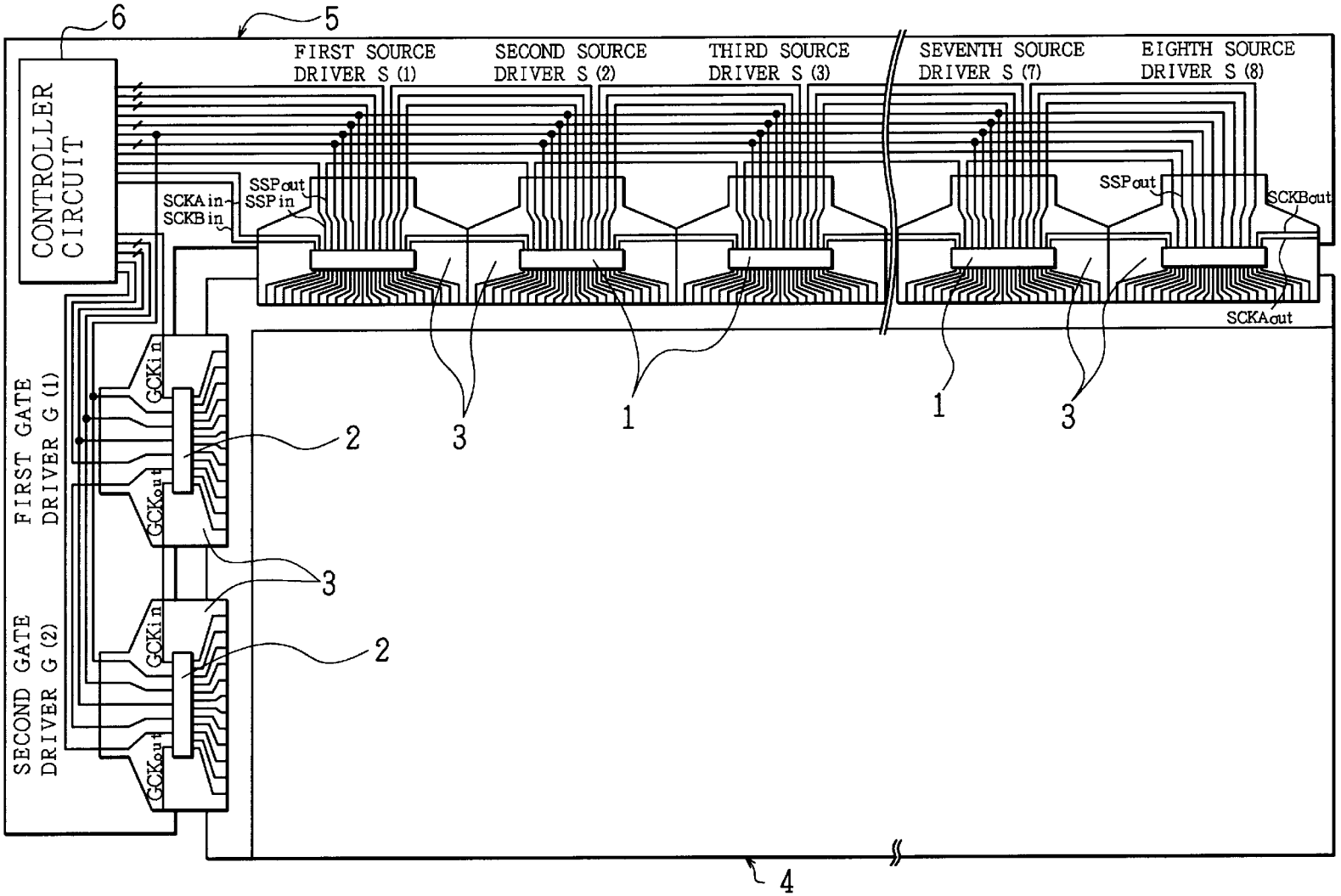
FIG. 2 is a plan view of the liquid crystal display device module.

FIG. 2 illustrates a drive circuit as a semiconductor device for driving a liquid crystal display section in a liquid crystal display device module (display device module) according to Embodiment 1. As illustrated in FIG. 2, for example, each of a plurality of source drivers 1 and gate drivers 2 is incorporated into a TCP (tape carrier package) and mounted on a periphery section of a liquid crystal panel 4. Each of these drivers is made of an LSI as a semiconductor processing section. In FIG. 2, in order to distinguish the source drivers 1 and the gate drivers 2, they are also referred to as the source driver S(n) (where n is a positive integer) or the gate driver G(p) (where p is a positive integer). The TCP is a thin package for supporting an LSI element by, for example, attaching the LSI element to a tape film.

These source drivers 1 drive source buslines (not shown) in the liquid crystal panel 4, while the gate drivers 2 drive gate buslines (not shown) therein.

Terminals (a group of terminals) of each of the source drivers 1 and gate drivers 2, which are located on the liquid crystal panel 4 side, are electrically connected to a terminal (not shown) formed by an ITO (indium tin oxide) on the liquid crystal panel 4 through the lines in the TCPs 3. For instance, electrical connection of the terminals is achieved by thermo-compression bonding them in the thickness direction with an ACF (anisotropic conductive film) therebetween.

Moreover, terminals of each of the source drivers 1 and gate drivers 2, which are located on a flexible substrate 5 side, are electrically connected to the lines on the flexible substrate 5 through the lines in the TCPs 3 by the above-mentioned ACF or soldering.

Therefore, supply of display-use data signals (three kinds of signals: R, G, B, and hereinafter referred to as the "display data D") to the source drivers 1 from a controller circuit 6 and supply of various control signals and power (GND, Vcc) to the source drivers 1 and the gate drivers 2 are performed through the lines on the flexible substrate 5 and the lines on the TCPs 3.

Here, for the source drivers 1, a total of eight source drivers, i.e., the first source driver S(1) to the eighth source driver S(8), are provided. Meanwhile, for the gate drivers G, a total of two gate drivers, i.e., the first gate driver G(1) and the second gate driver G(2), are provided.

Figure 3:
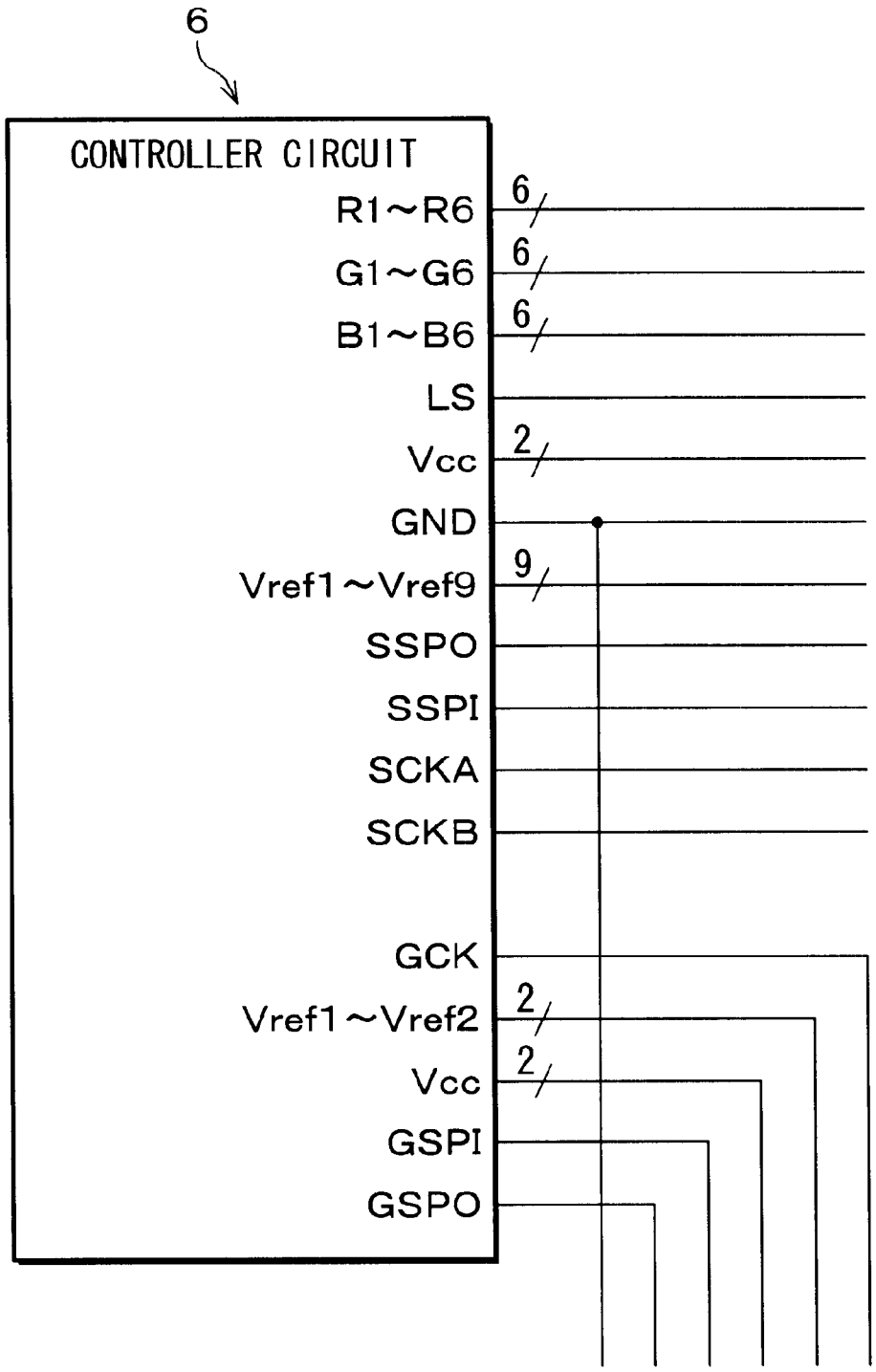
FIG. 3 is an explanatory view of the terminals of a controller circuit of the semiconductor device.

Regarding the first source driver S(1) to the eighth source driver S(8), eight identical source drivers 1 are connected in cascade. The display data signals R, G, B of the display data D, a start pulse input signal SSPI and two-phase clock signals SCKA and SCKB output from the controller 6 are supplied to the source drivers 1 by the self-transfer system. Additionally, regarding the first gate driver G(1) and the second gate driver G(2), two identical gate drivers 2 are connected in cascade. A clock signal GCK and a start pulse input signal GSPI output from the controller circuit 6 are supplied to the gate drivers 2 by the self-transfer system. FIG. 3 is an enlarged view of the structure of the terminals of the controller circuit 6.

The number of pixels in the liquid crystal panel 4 is, for example, 1024 pixels×3 (RGB) [on the source side]×768 pixels [on the gate side]. Therefore, each of the source drivers 1 of the first source driver S(1) to the eighth source driver S(8) drives 128 pixels×3 (RGB) for a display of 64 gray scales.

The following description will explain various signals and the transmission path thereof in the semiconductor device having the above-described structure.

The control circuit 6 includes terminals R1 to R6, G1 to G6, B1 to B6, SCKA, SCKB and SSPI. The display data signals R, G, B of the 6-bit display data D are output from the terminals R1 to R6, G1 to G6, and B1 to B6, respectively. The two-phase clock signals SCKA and SCKB are output from the terminals SCKA and SCKB, respectively. The start pulse input signal SSPI is output from the terminal SSPI. These signals are first input to the first source driver S(1) of the first stage.

Figure 1:
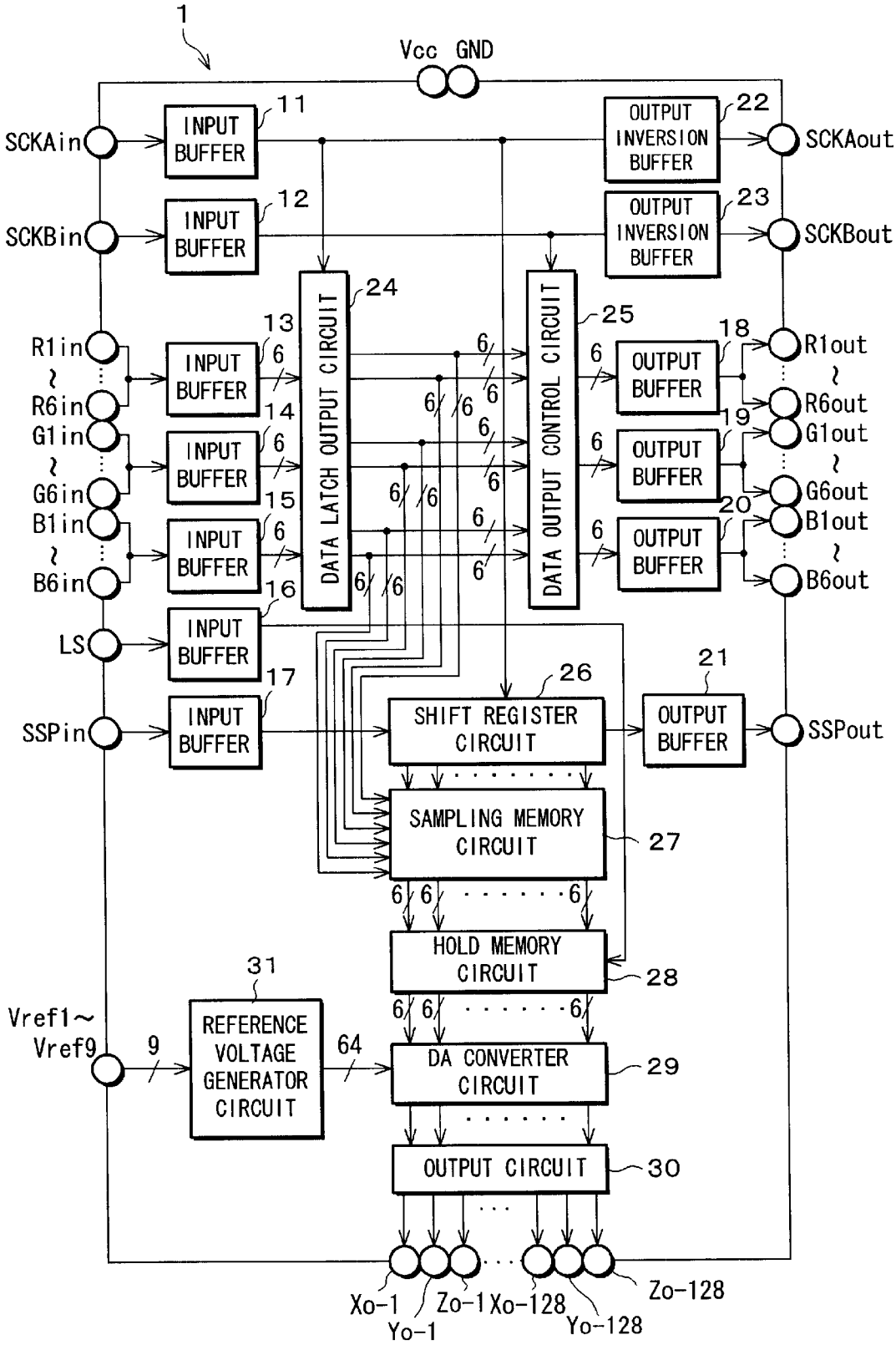
FIG. 1 is a block diagram showing the circuit structure of a source driver as a semiconductor device functioning as a drive device for a liquid crystal display device module according to Embodiment 1 of the present invention.

Here, as shown in FIG. 1, the display data signals R, G, B are input to the input terminals R1in to R6in, G1in to G6in, and B1in to B6 of the source driver 1 constituting the first source driver S(1), respectively. The clock signals SCKA and SCKB are input to the input terminals SCKAin and SCKBin of the source driver 1. The start pulse input signal SSPI is input to the input terminal SSPin of the source driver 1.

These input signals are output from the output terminals R1out to R6out, G1out to G6out, B1out to B6out, SCKAout, SCKBout and SSPout of the source driver 1 of the first source driver S(1), respectively, and forwarded to the source driver 1 of the second source driver S(2) of the next stage. In the same manner these signals are successively transferred to the third source driver S(3) to the eighth source driver S(8) (the self-transfer system).

Among these signals, the start pulse output signal SPO output from the output terminal SSPout of the source driver 1 of the eighth source driver S(8) passes through the lines on the flexible substrate 5 and is input to the terminal SSPO of the controller circuit 6.

The power supply terminal VCC and terminal GND line of each source driver 1, voltages Vref1 to Vref9 for 64-bit gray-scale display and latch signal LS from the controller circuit 6 are supplied as common signals to the source drivers 1 as the first source driver S(1) to eighth source driver S(8) through the lines on the flexible substrate 5. It is desirable that the latch signal LS is a pulse signal having the same pulse spacing as the horizontal synchronizing signal. However, the latch signal may be a pulse signal according to the horizontal synchronizing period, for example, a pulse signal having a pulse spacing given by an integer multiple or 1/n (n is an integer) of the horizontal synchronizing signal, if necessary.

On the other hand, the clock signal GCK and start pulse input signal GSPI for the gate driver 2, which were output from the terminals GCK and GSPI of the controller circuit 6, are also input first to the gate driver 2 as the first gate driver G(1) of the first stage. Here, although not shown in detail, similarly to the source driver S shown in FIG. 1, these clock signal GCK and start pulse input signal GSPI from the controller circuit 6 are input to the respective input terminals of the first gate driver G(1) of the first stage, output from the respective output terminals, and input to the respective input terminals of the second gate driver G(2). Moreover, the power supply terminal VCC and terminal GND line of each gate driver 2 and voltages Vref1 to Vref2 to be applied to the liquid crystal panel 4 are supplied as common signals to the gate drivers 2 from the controller circuit 6.

Next, referring to FIG. 1, the following description will explain the circuit structure of the source driver 1. As illustrated in FIG. 1, the source driver 1 includes input buffers 11 to 17, output buffers 18 to 21, output inversion buffers 22 and 23, a data latch output circuit (dividing means) 24, a data output control circuit (synthesizing means) 25, a shift register circuit 26, a sampling memory circuit 27, a hold memory circuit 28, a reference voltage generator circuit 31, a DA converter circuit 29, and an output circuit 30.

Only the structural differences between the above circuit and the prior art will be explained below. The main differences from the conventional source driver 51 explained in FIG. 22 where the clock signal SCK is a single-phase transfer-use clock signal are ① inputting of two-phase clock signals SCKA and SCKB including the clock signal SCKB which is used to synchronize the display data D and has a different phase from the clock signal SCKA, in addition to the clock signal SCKA that is the same transfer-use clock as the clock signal SCK, ② inclusion of the data latch output circuit 24 in the input section, for latching the display data D as timing by using both of the leading and trailing edges of the clock signal SCKA as the fetching timing, dividing it into two data to convert the display data D into parallel data, and ③ inclusion of the data output control circuit 25 for converting the divided display data D back into the serial data before outputting the display data D to the next source driver 1.

Figure 22:
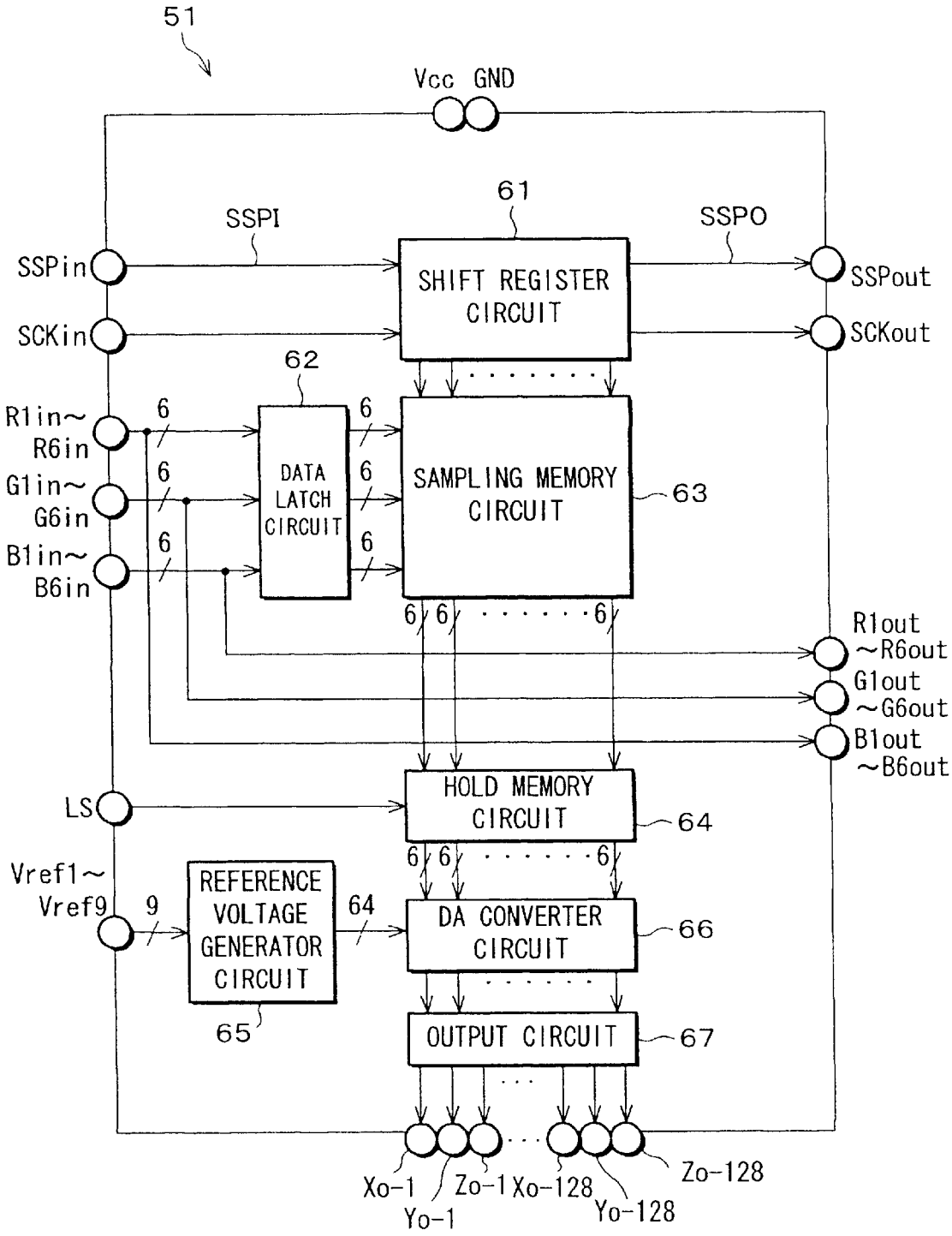
FIG. 22 PRIOR ART
FIG. 22 is a block diagram showing the circuit structure of the source driver.
Figure 23:
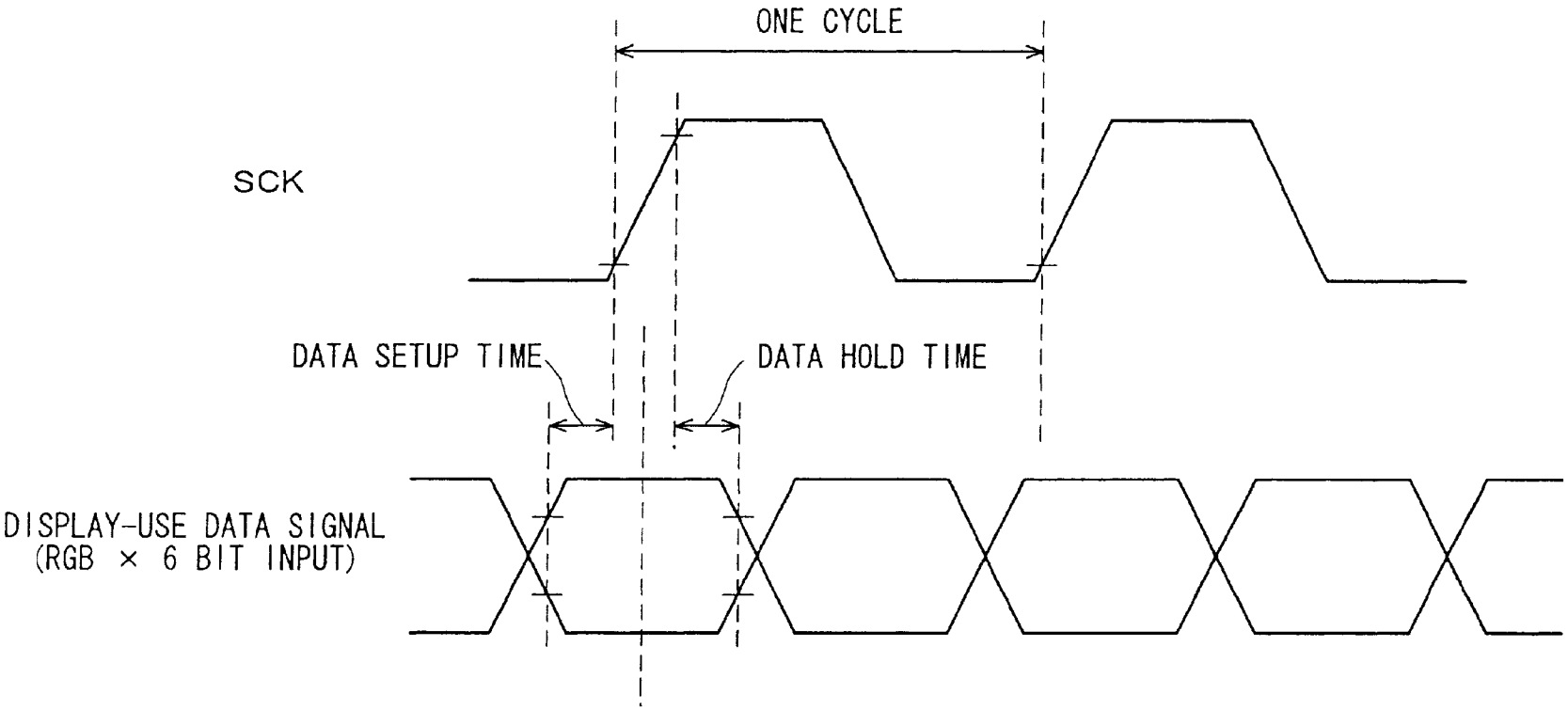
FIG. 23 PRIOR ART
FIG. 23 is a timing chart showing the data fetching timing in the source driver.

Therefore, in the embodiments, the explanation of the shift register circuit 26, the hold memory circuit 28, the reference voltage generator circuit 31, the DA converter 29 and the output circuit 30 which have no particular differences from those shown in FIG. 22 will be omitted.

First, in the source driver 1, the input terminal SCKAin is an input terminal for the transfer-use clock signal and used to shift (transfer) the start pulse input signal SSPI with the shift register circuit 26. Between the two-phase clock signals SCKA and SCKB, the clock signal SCKA (hereinafter referred to as the transfer-use clock signal SCKA) as the transfer clock (shift clock) is input to the above input terminal. The output terminal SCKAout is an output terminal for transferring the transfer-use clock signal SCKA to the source driver S of the next stage.

The terminal SCKBin is an input terminal of the synchronizing clock signal for synthesizing the display data D again by synchronization in the data output control circuit 25. Between the two-phase clock signals SCKA and SCKB, the clock signal SCKB for synchronizing the display data D (hereinafter referred to as the synchronizing clock signal SCKB) is input to the above input terminal. The output terminal SCKBout is an output terminal for transferring the synchronizing clock signal SCKB to the source driver S of the next stage.

The 6-bit display-use data signals R, G, B output from the terminals R1 to R6, G1 to G6 and B1 to B6 of the controller circuit 6 are serially input to the input terminals R1in to R6in, G1in to G6in and B1in to B6in of the source driver 1 as the first source driver S(1), respectively, and input to the data latch output circuit 24 through input buffers 13 to 15, each of which consists of six input buffers.

The data latch output circuit 24 synchronizes the display data D temporarily with both of the leading and trailing edges of the transfer-use clock signal SCKA, and then outputs the display data D to the sampling circuit 27. The operation of the data latch output circuit 24 will be described in detail later.

Moreover, the display data D which has temporarily been latched in the data latch output circuit 24 is also output to the data output control circuit 25. The data output control circuit 25 is supplied with the synchronizing clock signal SCKB, and converts the display data signals R, G, B divided in the data latch output circuit 24 into one-channel serial data according to the synchronizing clock signal SCKB before transfer to the source driver S of the next stage so that the display data D is synchronized again with both of the leading edge and trailing edge of the transfer-use clock signal SCKA. The operation of the data output control circuit 25 will be also described in detail later.

Here, the synchronizing clock signal SCKB is a signal having a phase delayed from the transfer-use clock signal SCKA, for example, by an amount of ¼ cycle, and the data output control circuit 25 uses the synchronizing clock signal SCKB to convert the display data D divided into two channels into one-channel serial data. As a result, it is possible to ensure a margin for the data setup/hold time of the source driver S of the next stage, thereby ensuring the data setup/hold time of the source driver S of the next stage.

Figure 4:
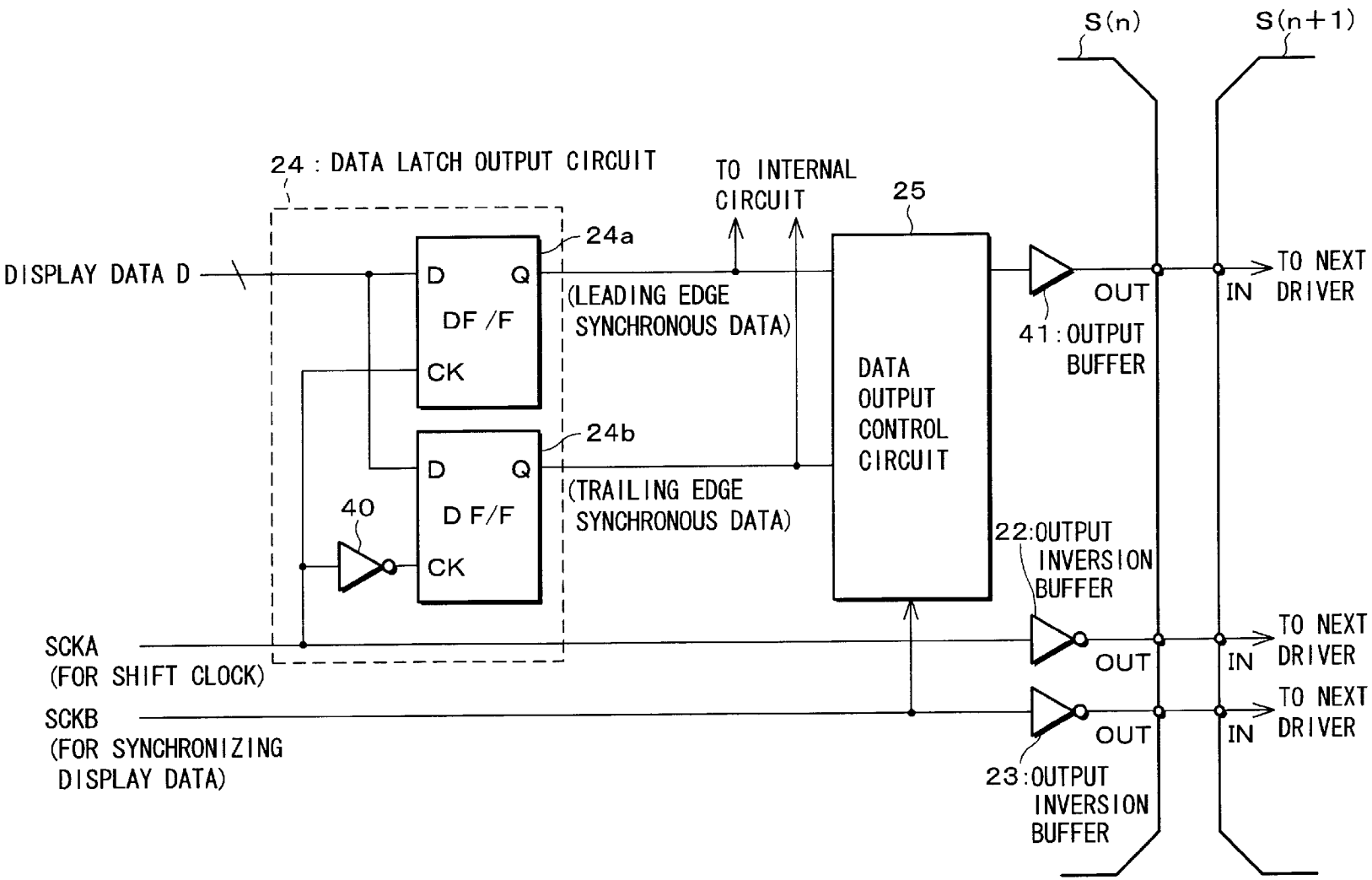
FIG. 4 is a block diagram of essential sections in the source driver.

FIG. 4 shows in detail the circuit structure of the source driver S(n) connected in cascade to the source driver S(n+1). As illustrated in FIG. 4, the data latch output circuit 24 of the source driver 1 as the source driver S(n) includes two D-type flip-flops (hereinafter referred to as the "DF/F") 24*a* and 24*b*.

Identical display data D are input to the respective input terminals D of these two DF/F 24*a* and 24*b*, and the outputs from the respective output terminals Q of the DF/F 24*a* and 24*b* are output to the sampling memory circuit 27 as the internal circuit and also to the data output control circuit 25.

Furthermore, the transfer-use clock signal SCKA (as the shift clock) is input to the clock terminal CK of the DF/F 24*a*. The transfer-use clock signal SCKA is inverted by the inverter 40 and then input to the clock terminal CK of the DF/F 24*b*.

The synchronizing clock signal SCKB (for synchronizing display data) is input to the data output control circuit 25. The output of the data output control circuit 25 is taken out through an output buffer 41 (any one of the output buffers 18 to 20 shown in FIG. 1, each of which consists of six output buffers), and transferred to the next adjacent source driver S(n+1).

The transfer-use clock signal SCKA and synchronizing clock signal SCKB are taken out after inversion through the output inverting buffers 22 and 23, and transferred to the next adjacent source driver S(n+1).

Figure 5:
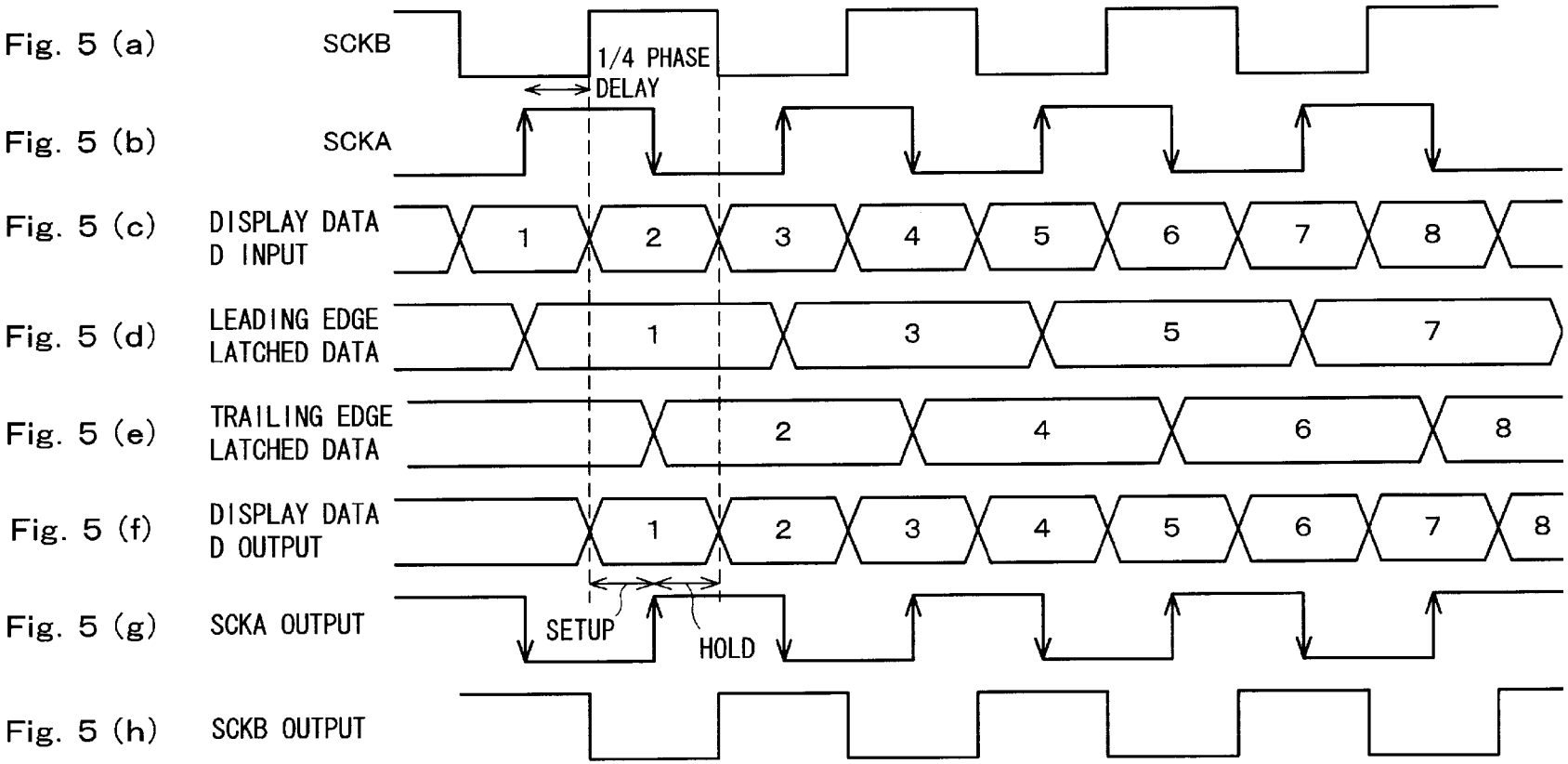
FIGS. 5(*a*) to 5(*h*) are timing charts of signals in the source driver.

FIG. 5 shows the timing chart of various signals. Referring to the circuit block diagram of FIG. 4, the following description will explain in detail the operations of the respective sections.

Here, the phase of the synchronizing clock signal SCKB [FIG. 5(*a*)] is delayed from the transfer-use clock signal SCKA [FIG. 5(b)] by an amount of ¼ phase. The transfer-use clock signal SCKA is input first to the DF/F 24*a* between the two DF/F 24*a* and DF/F 24*b* constituting the data latch output circuit 24. On the other hand, the transfer-use clock signal /SCKA (the inverted signal of the transfer-use clock signal SCKA) inverted through the inverter 40 is input to the clock terminal CK of the DF/F 24*b*.

The DF/F outputs the signal of the input terminal D to the output terminal Q in synchronism with the rise of the signal input to the clock terminal CK, and latches the output from the output terminal Q at other timing.

Thus, the DF/F 24*a* fetches the display data D upon the rise of the transfer-use clock signal SCKA and outputs it from the output terminal Q. On the other hand, the DF/F 24*b* fetches the display data D upon the fall of the transfer-use clock signal SCKA (the rise of the transfer-use clock signal /SCKA) and outputs it to the output terminal Q.

Consequently, as shown in FIG. 5(*d*), the output Q of the DF/F 24*a* fetches and latches the odd-number display data D of the input display data D (FIG. 5(*c*)) (corresponding to the leading edge latched data). On the other hand, as shown in FIG. 5(*e*)), the output Q of the DF/F 24*b* fetches and latches the even-number display data D of the input display data D (FIG. 5(*c*)) (corresponding to the trailing edge latched data).

Thus, since the display data D is divided into two channels by the two DF/Fs 24*a* and 24*b*, the data transfer rate becomes ½. For instance, if the necessary data transfer rate of the display data D is 80 MHz, the clock frequency of the transfer-use clock signal SCKA can be reduced to 40 MHz, i.e., reduced to a half.

Incidentally, as shown in FIG. 5(*c*), the display data D is transferred from the source driver S(n−1) connected to the previous stage, in synchronism with the displacement points (the leading and trailing edges) of the synchronizing clock signal SCKB of the display data D.

The above-mentioned leading edge latched data and trailing edge latched data obtained by dividing the display data D into two channels are forwarded to the sampling memory circuit 27 by time division in accordance with the outputs of the shift register circuit 26 which transfers/outputs the start pulse input signal SSPI in synchronism with the rise of the transfer-use clock signal SCKA.

The display data D as parallel data once stored in the sampling memory circuit 27 is transferred simultaneously to the hold memory circuit 28 according to the horizontal synchronizing signal LS (not shown), and the output of the hold memory circuit 28 lathes the display data D until the next horizontal synchronizing signal LS is input.

Here, since the data transfer rate from the data latch output circuit 24 to the sampling memory circuit 27 is ½, the sampling memory circuit 27 can meet the high-speed operation and have margins for the setup time and hold time, thereby facilitating the designing of the circuit, including the layout. Moreover, since a higher data transfer rate is achievable, it is possible to contribute to the realization of a large-area high-definition display device.

The display data D divided into two channels is converted again into the original time series one-channel serial data [FIG. 5(*f*)] by fetching the display data D in synchronism with the displacement points (the leading and trailing edges) of the clock signal SCKB for synchronizing the display data D in the data output control circuit 25.

For instance, this data output control circuit 25 includes two transmission gates to realize the above-mentioned conversion. The conversion can be carried out as follows. The leading edge synchronous data is input to the input of one of the transmission gates. The trailing edge synchronous data is input to the input of the other transmission gate. The outputs of these transmission gates are connected and output to the output buffer 41. As a control signal for opening and closing the transmission gates, the synchronizing clock signal SCKB is input to one of control terminals, while the synchronizing clock signal /SCKB (the inverted signal of the synchronizing clock signal SCKB) is input to the other control terminal, thereby realizing the conversion. Further, the detail of the data output control circuit will be described later.

The synchronizing clock signal SCKB and the transfer-use clock signal SCKA are output to the source driver S(n+1) of the next stage through the inversion output buffers 22 and 23, respectively [FIG. 5(*g*) and FIG. 5(*h*)].

Thus, by inverting the synchronizing clock signal SCKB and the transfer-use clock signal SCKA and outputting them to the next stage, the timing (phase) of the display data D, the synchronizing clock signal SCKB and the transfer-use clock signal SCKA at the input stage of the source driver S(n+1) of the next stage can be made the same as that at the input stage of the source driver S(n).

More specifically, even when high-speed display data D is input to the data latch output circuit 24 through the output buffers (18–20) in FIG. 1 and the input buffers (13 to 15 in FIG. 1) of the next stage, the setup time and hold time necessary for the data latch output circuit 24 to latch the display data D are kept. This means that there would be no problem even if the source drivers S are connected in cascade over a number of stages so as to transfer the high-speed display data D. Note that, circuits such as the input buffers and output buffers whose explanation is not necessary are omitted in FIG. 4.

As described above, in the semiconductor device of Embodiment 1, the system for fetching the display data D at both of the leading and trailing edges of the transfer-use clock signal SCKA is employed in the data latch output circuit 24 as an input interface section (input section), the display data D sent serially over one channel is divided into two channels to convert it into parallel data in the source driver 1, and then converted again to the one-channel serial data at output, i.e., in the data output control circuit 25.

With this structure, the clock frequency can be reduced to a half of the data transfer rate (data frequency), and the transfer timing of the display data D to be successively transferred to the source driver 1 of the next stage is controlled, for example, delayed. Consequently, according to the above-described structure, the specifications (data setup/hold time) for the data fetching timing of the display data D can be easily ensured in the source drivers 1.

As a result, the above structure can realize the source driver 1 as a semiconductor device capable of performing a highly reliable display operation by the widening of the operating frequency of the transfer-use clock signal SCKA and the decrease of the operating frequency of the transfer-use clock signal SCKA, and a display device module such as a liquid crystal display device module using the semiconductor device.

Embodiment 2

Referring now to FIG. 6 to FIG. 10, the following description will explain another embodiment of the present invention. In Embodiment 2, the members having the same functions as those in Embodiment 1 will be designated by the same codes and the explanation thereof will be omitted.

In Embodiment 1, the synchronizing clock signal SCKB is generated together with the transfer-use clock signal SCKA in the external controller circuit 6. In this case, it is necessary to take the influences of the line capacity and capacitive coupling between the lines of the clock signals (the phase timing of the transfer-use clock signal SCKA and synchronizing clock signal SCKB and deterioration of the duty ratio of the transfer-use clock signal SCKA) into consideration.

Figure 6:
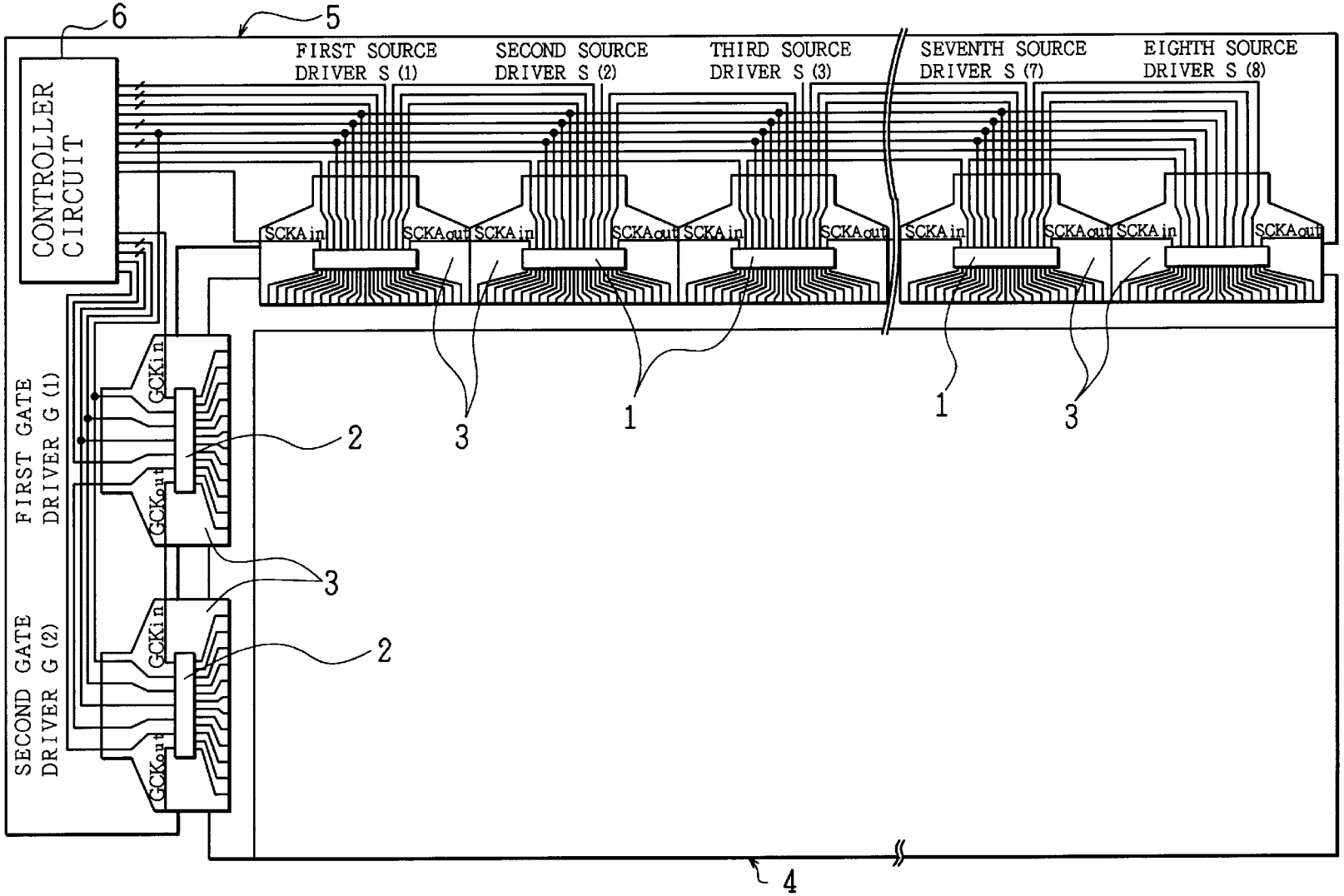
FIG. 6 is a plan view of the liquid crystal display device module according to Embodiment 2 of the present invention.
Figure 7:
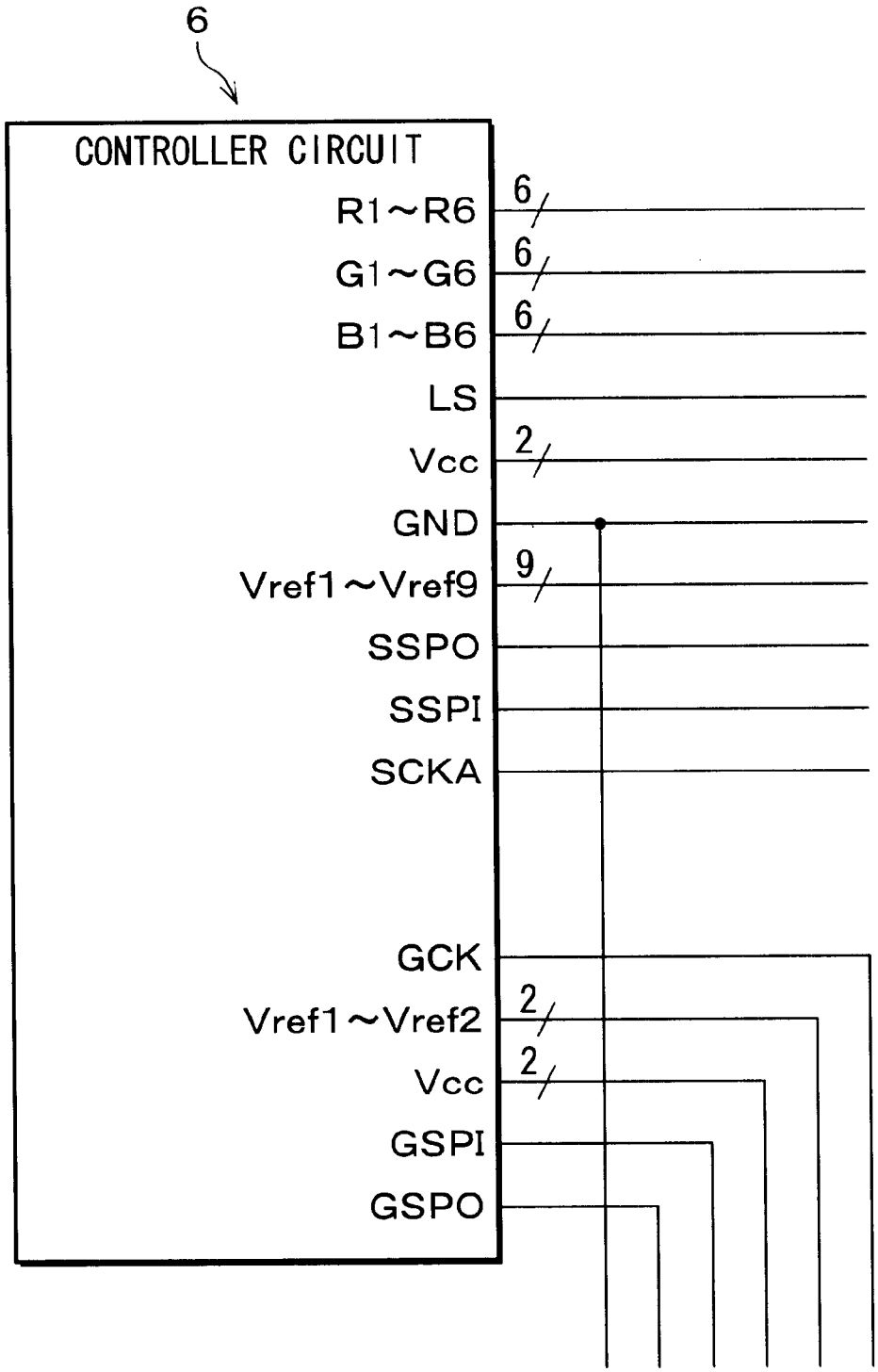
FIG. 7 is an explanatory view of the terminals of a controller circuit of the liquid crystal display device module.
Figure 8:
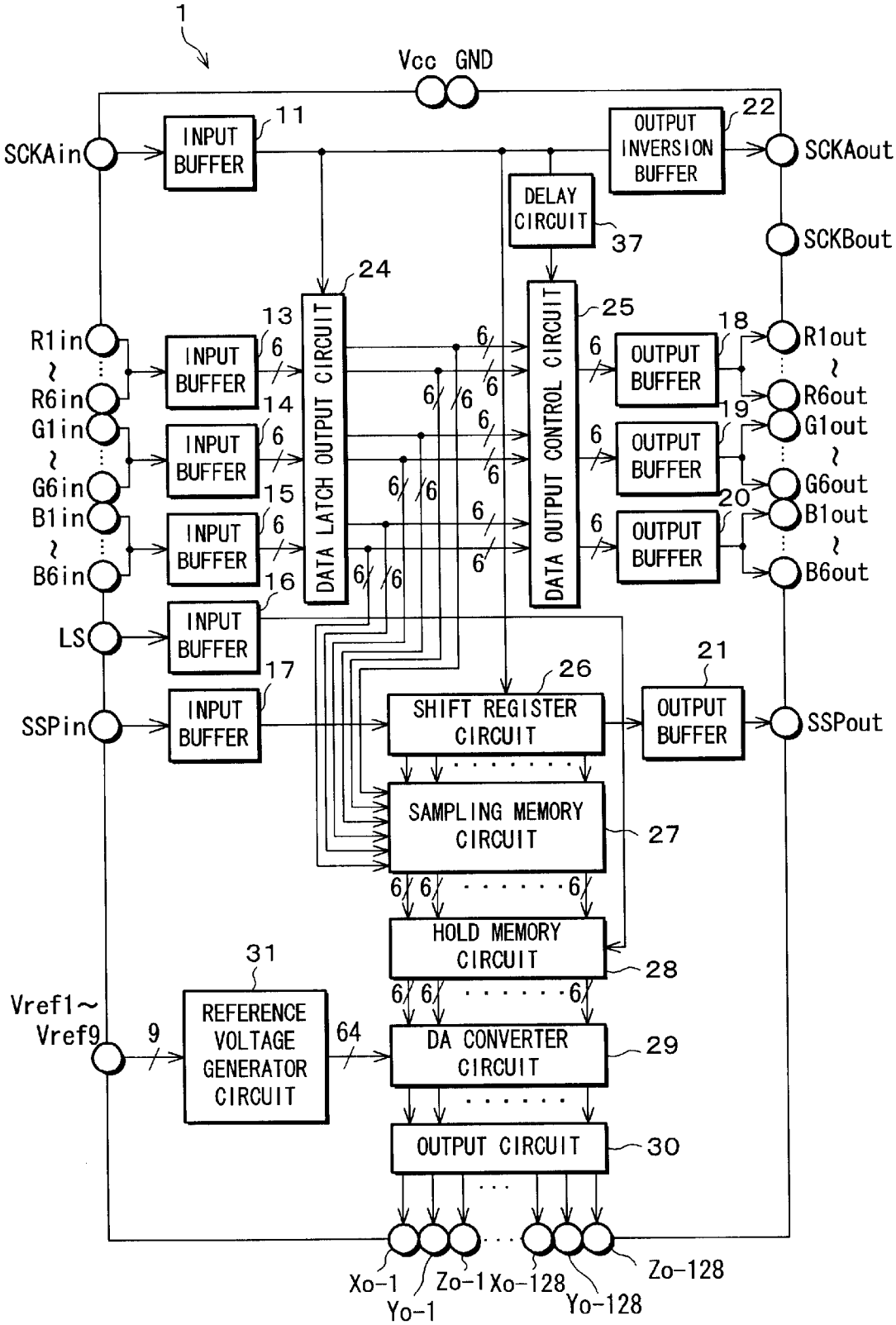
FIG. 8 is a block diagram of the circuit structure of the source driver.
Figure 9:
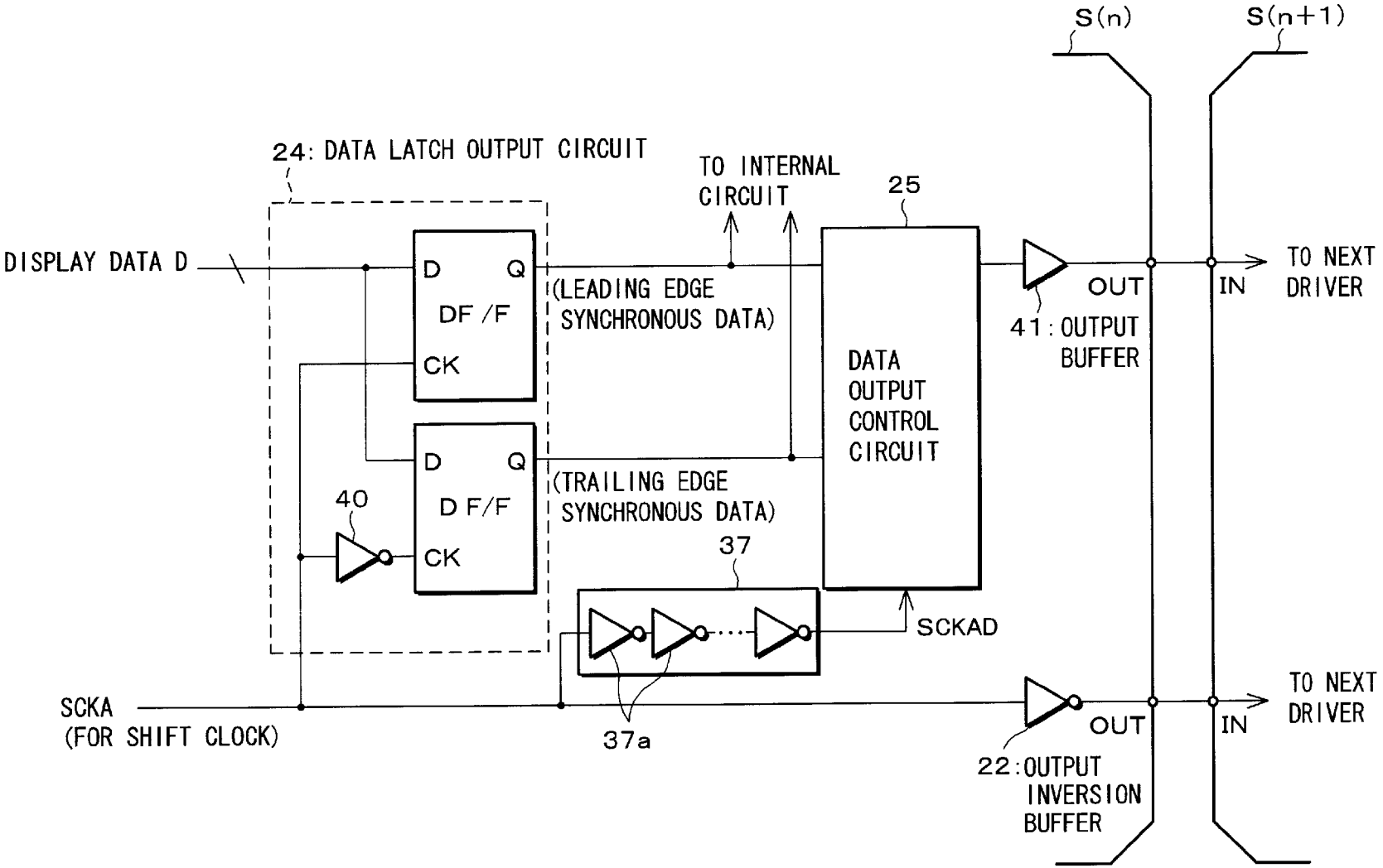
FIG. 9 is a block diagram of essential sections in the source driver.

Then, in the semiconductor device of Embodiment 2, as illustrated in FIG. 6 to FIG. 8, only one phase of the transfer-use clock signal SCKA is input, and this transfer-use clock signal SCKA is delayed to produce a synchronizing clock signal SCKD which is to be input to the data output control circuit 25. For instance, as shown in FIG. 9, the delay circuit 37 can be achieved by inverters 37*a* arranged in a number of stages. Here, an example using the inverters 37*a* as the delay circuit 37 has been explained. However, the present invention is not necessarily limited to such a structure and, for example, a delay may be introduced by a delay circuit formed by a combination of a resistor and capacitor.

Similarly to Embodiment 1, in Embodiment 2, the system for fetching the display data D at both of the leading and trailing edges of the transfer-use clock signal SCKA is employed in the input section, the one-channel display data D as serial data is divided into two channels so as to convert it into parallel data in the source driver 1, and converted again into the original one-channel data at the output section, thereby reducing the clock frequency to a half of the data transfer rate (data frequency) of the display data D and realizing a wider operating frequency range of the transfer-use clock signal SCKA, a highly reliable semiconductor device and a liquid crystal display device module using the semiconductor device.

Figures 10A, 10B, 10C, 10D, 10E, 10F, 10G:
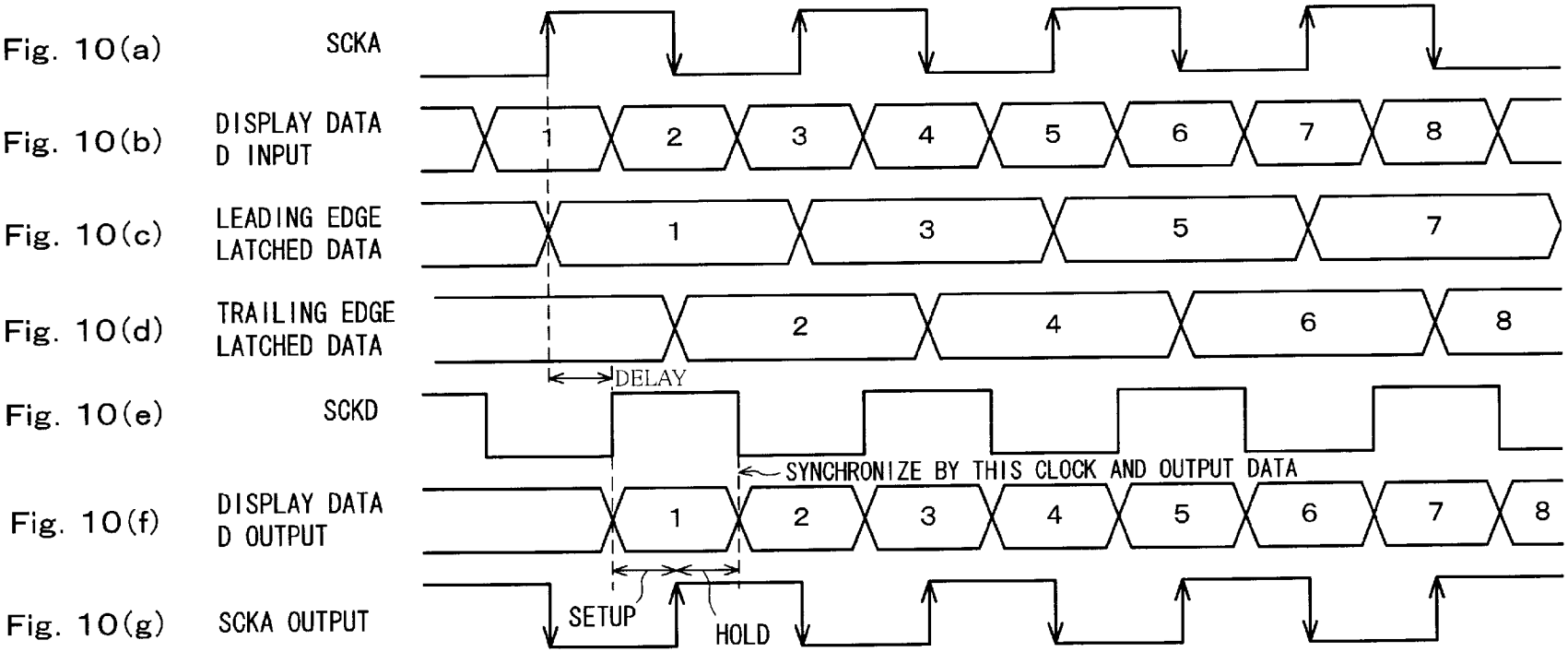
FIGS. 10(*a*) to 10(*g*) are timing charts of signals in the source driver.

FIG. 10 shows a timing chart of various signals in the semiconductor device of this embodiment. Here, since the operation of this embodiment is the same as that in Embodiment 1 if the synchronizing clock signal SCKD is replaced by the synchronizing clock signal SCKB, the explanation of the operation will be omitted As described above, by producing the synchronizing clock signal SCKD within the source driver 1, the line between the controller circuit 6 and the first source driver S(1) of the first stage, the line between the source driver S and the source driver S of the next stage, and the lines on the TCP 3 can be reduced.

Consequently, with the above-described structure, the influences of noise caused by the roundness of the waveform due to the line capacity and coupling between the high-speed clock signal lines, etc. are diminished, and a higher data transfer rate can be realized. Moreover, since only one transfer-use clock signal SCKA needs to be ensured, the operating specifications with respect to the external transfer-use clock are simplified, and the frequency margin can be significantly increased.

Embodiment 3

Referring now to FIG. 11 to FIG. 17, the following description will explain still another embodiment of the present invention as Embodiment 3. In Embodiment 3, the members having the same structures and functions as those in Embodiments 1 and 2 will be designated by the same codes and the explanation thereof will be omitted.

In Embodiment 1, clock signals of two phases, i.e., the transfer-use clock signal SCKA and synchronizing clock signal SCKB, are input to the source driver 1 from the controller circuit 6.

Besides, in Embodiment 2, considering the influences of the line capacity and capacitive coupling between the lines of the clock signals, the delay circuit 37 is provided with a synchronizing clock signal generator circuit for producing the synchronizing clock signal SCKD from the one-phase transfer-use clock signal SCKA by shifting the phase, so that the synchronizing clock signal SCKD is used in synthesizing the one-channel display data D.

However, in order to meet the tendency to higher definition of the display image quality of the liquid crystal panel 4, the specifications (data setup/hold time) for the data fetching timing according to the clock signals become more strict. It is therefore necessary to take these specifications into consideration.

Then, in Embodiment 3, in addition to the two phases transfer-use clock signal SCKA and synchronizing clock signal SCKB of different phases, a clock signal SCKA1 as a transfer-use clock signal to be input to one of the data latch output circuits 24 is newly produced by delaying the transfer-use clock signal SCKA by the delay circuit 32. Examples of the delay circuit 32 include inverters connected in series (in cascade) over a number of stages, and a delay circuit using a resistor and capacitor.

Figure 11:
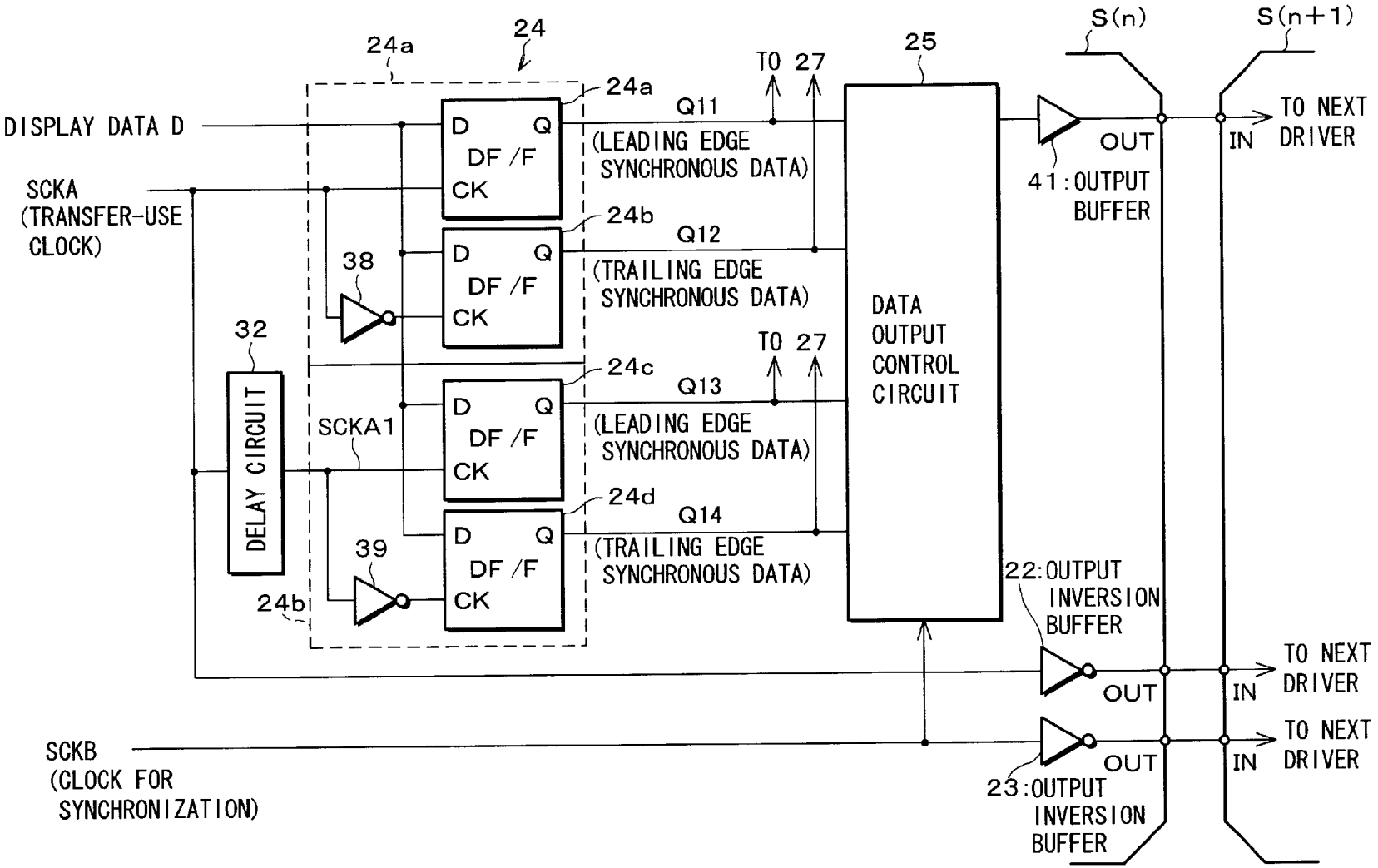
FIG. 11 is a block diagram of essential sections in the source driver according to Embodiment 3 of the present invention.

FIG. 11 shows a specific circuit structure of the source driver S(n) connected in cascade to the source driver S(n+1). The difference of the source driver S(n) from those shown in Embodiments 1 and 2 is that a new phase, for example, the transfer-use clock signal SCKA1 having a phase shift of ¼ phase with respect to the transfer-use clock signal SCKA is generated and the same circuit block as the data latch output circuit 24 is added as shown in FIG. 11. Therefore, the semiconductor device according to Embodiment 3 can further decrease the data transfer rate of the display data D to, for example, ¼ by operating the additional data latch output circuit 24 (DF/F 24*c* and DF/F 24*d*) with the transfer-use clock signal SCKA1.

Figures 12A, 12B, 12C, 12D, 12E, 12F, 12G, 12H, 12I, 12J, 12K:
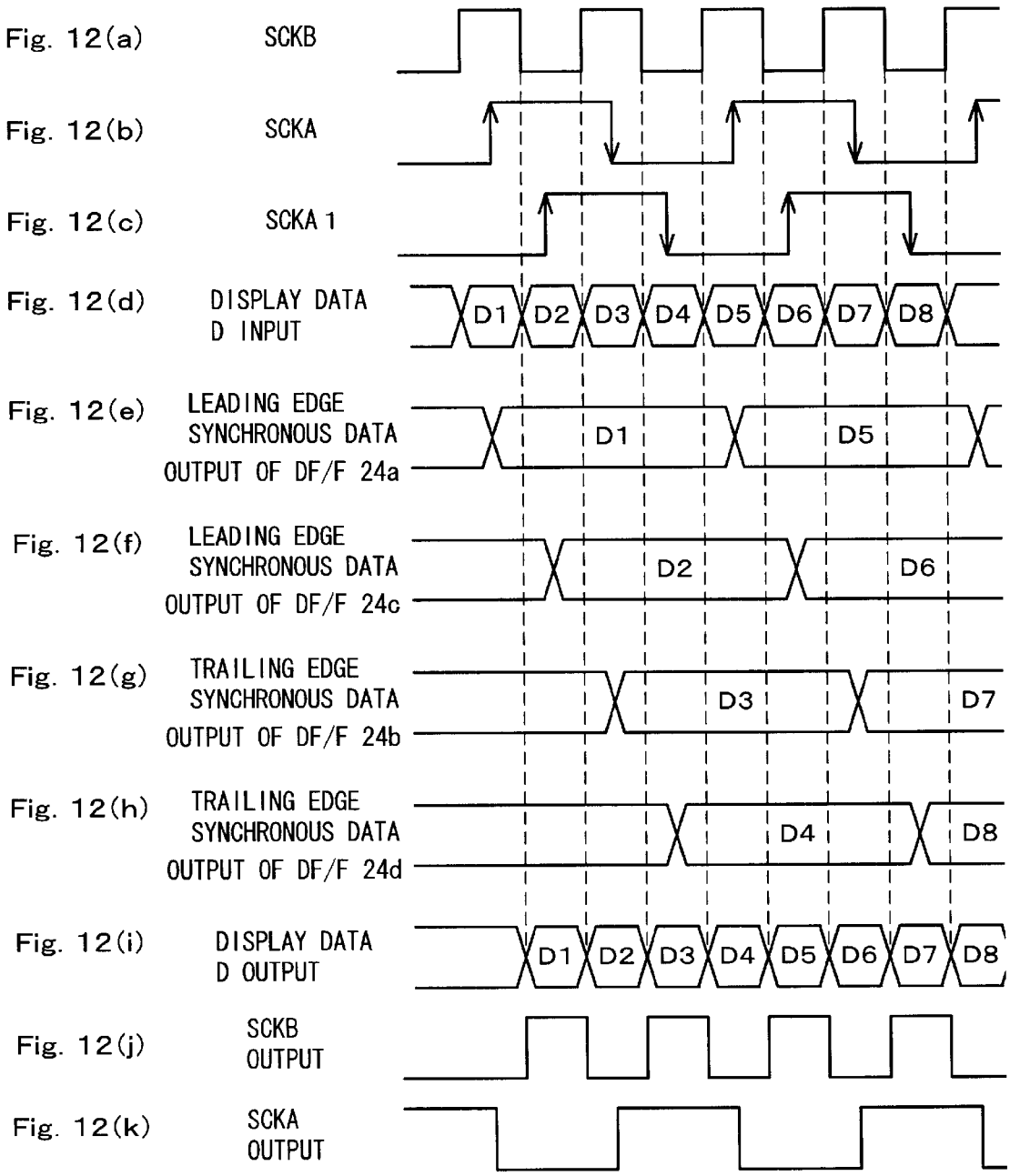
FIGS. 12(*a*) to 12(*k*) are timing charts of signals in the source driver.

Namely, the display data D [see FIG. 12(*d*)] is transferred to the source driver S(n) in synchronism with the rise and fall of the synchronizing clock signal SCKB [see FIG. 12(*a*)]. The transfer-use clock signal SCKA [see FIG. 12(*b*)] is a signal produced to have ½ frequency by dividing the synchronizing clock signal SCKB and a phase delayed from the synchronizing clock signal SCKB by an amount of ¼ phase in a control circuit (not shown).

Meanwhile, the newly provided transfer-use clock signal SCKA1 [see FIG. 12(*c*)] is a signal produced by further delaying the transfer-use clock signal SCKA by an amount of ¼ phase in the delay circuit 32. As described above, the delay circuit 32 may be readily achieved by connecting the inverters in series, introducing a delay by a resistor and capacitor, or other methods.

Such a relationship in terms of the delay needs to satisfy the phase relationship among the clock signals SCKA, SCKB and SCKA1 shown in FIGS. 12(*a*) to 12(*c*). In particular, a delay of ¼ phase is preferable because it can be readily produced from an original oscillator (not shown) for producing various signals.

Four DF/F 24*a* to 24*d* constituting the data latch output circuits 24 will be explained below. First, the transfer-use clock signal SCKA is input to the clock terminal CK of the DF/F 24*a*. The clock terminal CK of the DF/F 24*b* is supplied with the /SCKA (the inverted signal of the transfer-use clock signal SCKA) through an inverter 38.

Moreover, the transfer-use clock signal SCKA is input to the clock terminal CK of the DF/F 24*c* through the delay circuit 32. The clock terminal CK of the DF/F 24*d* is supplied with the /SCKA1 (the inverted signal of the transfer-use clock signal SCKA1) through an inverter 39.

The DF/F outputs a signal of the input terminal D (the common display data is input to the four input terminals D) to the output terminal Q in synchronism with the rise of the signal input to the clock terminal CK, and latches the output from the output terminal Q at other timing.

Besides, the DF/F 24*c* fetches the display data D upon the rise of the transfer-use clock signal SCKA1 and outputs it from the output terminal Q [see FIG. 12(*f*)]. On the other hand, the DF/F 24*d* fetches the display data D upon the fall of the transfer-use clock signal SCKA1 (the rise of the transfer-use clock signal /SCKA1) and outputs it from the output terminal Q [see FIG. 12(*h*)].

Therefore, the output Q11 of the DF/F 24*a* fetches and latches the (4n+1)th data (where n=0, 1, 2, 3 . . . ) of the display data D input as shown in FIG. 12(*e*). Moreover, the output Q12 of the DF/F 24*b* fetches and latches the (4n+3)th data of the display data D input as shown in FIG. 12(*g*). Furthermore, the output Q13 of the DF/F 24*c* fetches and latches the (4n+2)th data of the display data D input as shown in FIG. 12(*f*). Finally, the output Q14 of the DF/F 24*d* fetches and latches the (4n+4)th data of the display data D input as shown in FIG. 12(*h*).

Thus, since the display data D is divided into four channels by the four DF/Fs 24*a*, 24*b*, 24*c* and 24*d*, the data transfer rate of the display data D is reduced to ¼. For instance, if the necessary data transfer rate of the display data D is 80 MHz, the clock frequency of the transfer-use clock signal SCKA can be reduced to 20 MHz.

Besides, as shown in FIG. 12(*a*), the display data D is transferred from the source driver S(n−1) connected to the previous stage in synchronism with the displacement points (both of the leading and trailing edges) of the synchronizing clock signal SCKB.

The leading edge synchronous data and trailing edge synchronous data divided into four channels are forwarded to the sampling memory circuit 27 by time division according to the outputs of the shift register circuit 26 which transfers/outputs the start pulse input signal SSPI in synchronism with the rise of the transfer-use clock signal SCKA, and converted into parallel data.

The parallel data temporarily stored in the sampling memory circuit 27 is transferred simultaneously to the hold memory circuit 28 in accordance with the above-mentioned latch signal LS (not shown), and the output of the hold memory circuit 28 latches the parallel data until the next latch signal LS is input.

Here, since the data transfer rate from the data latch output circuit 24 to the sampling memory circuit 27 is ¼, the requirements to achieve the high-speed operation with respect to the sampling memory circuit 27 are eased and the margins for the setup time and hold time are increased, thereby facilitating the designing of the circuit, including the layout. Moreover, since a higher data transfer rate is achievable, it is possible to contribute to the realization of a large-area high-definition display device.

The display data D divided into four channels is converted again into the original time series one-channel serial data [FIG. 12(*i*)] by fetching the display data D in synchronism with the displacement points (the leading and trailing edges) of the clock signal SCKB for synchronizing the output data in the data output control circuit 25.

Figure 13:
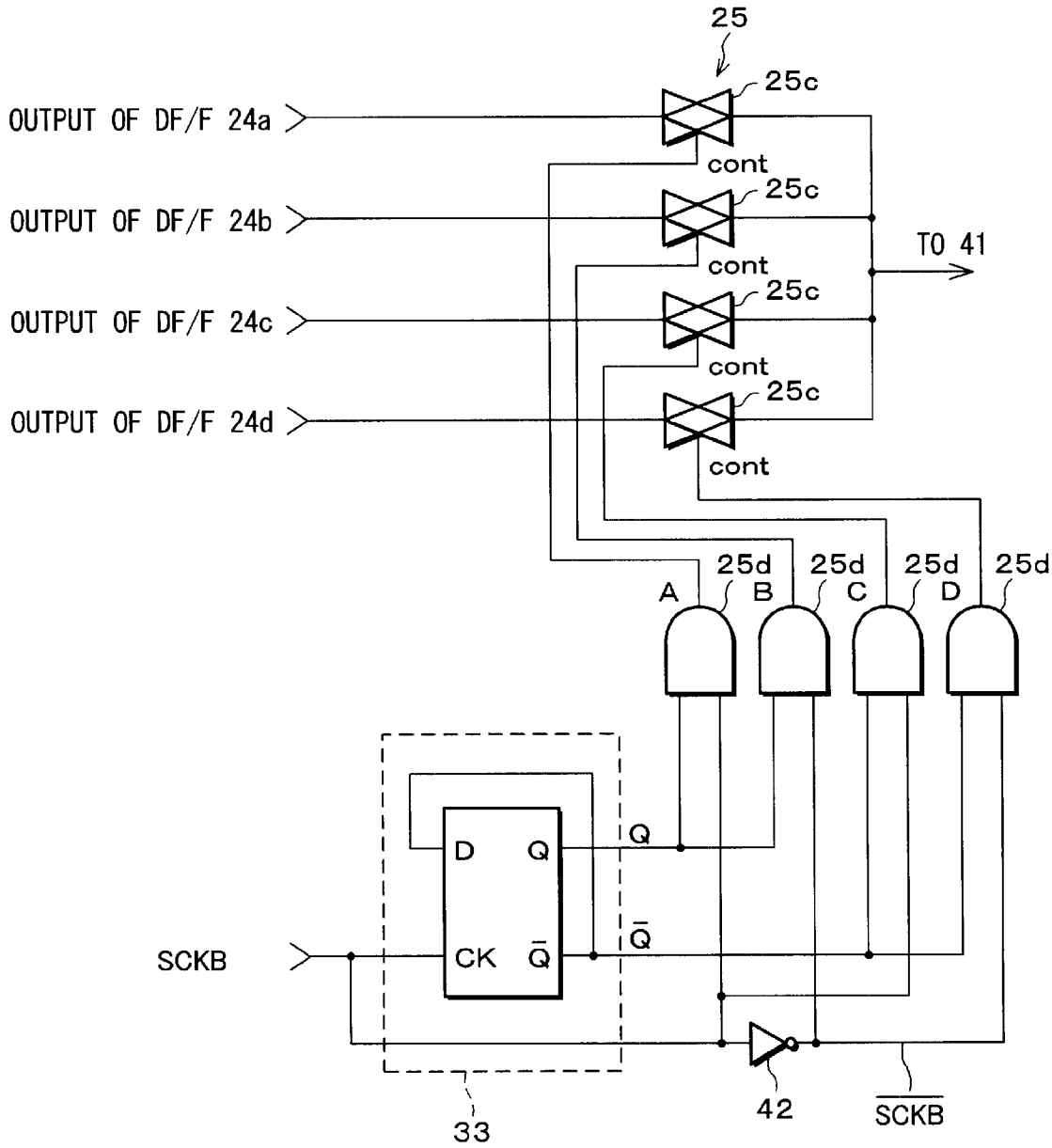
FIG. 13 is a block diagram of a data output control circuit of the source driver.

One example of the structure of this data output control circuit 25 is illustrated in FIG. 13. As shown in FIG. 13, the data output control circuit 25 includes four transmission gates (converting means) 25*c*. Four outputs of the data latch output circuit 24 are input to the inputs of the transmission gates 25*c*, respectively. Besides, the outputs of the transmission gates 25*c* are connected together and output to the output buffer 41.

Control signals A, B, C and D are input to the control terminals cont for controlling the opening and closing of the transmission gates 25*c*, respectively. For instance, each of the control terminal cont opens the transmission gate 25*c* when the input signal is high level, while closes the transmission gate 25*c* when the input signal is low level. The control signals A, B, C and D are produced from the synchronizing clock signal SCKB, signal Q, synchronizing clock signal /SCKB and signal /Q in the AND circuits 25*d*. The synchronizing clock signal /SCKB is generated by inverting the synchronizing clock signal SCKB by the inverter 42. The signals Q and /Q are generated from the synchronizing clock signal SCKB by a frequency divider circuit 33 formed by a DF/F.

Figure 14:
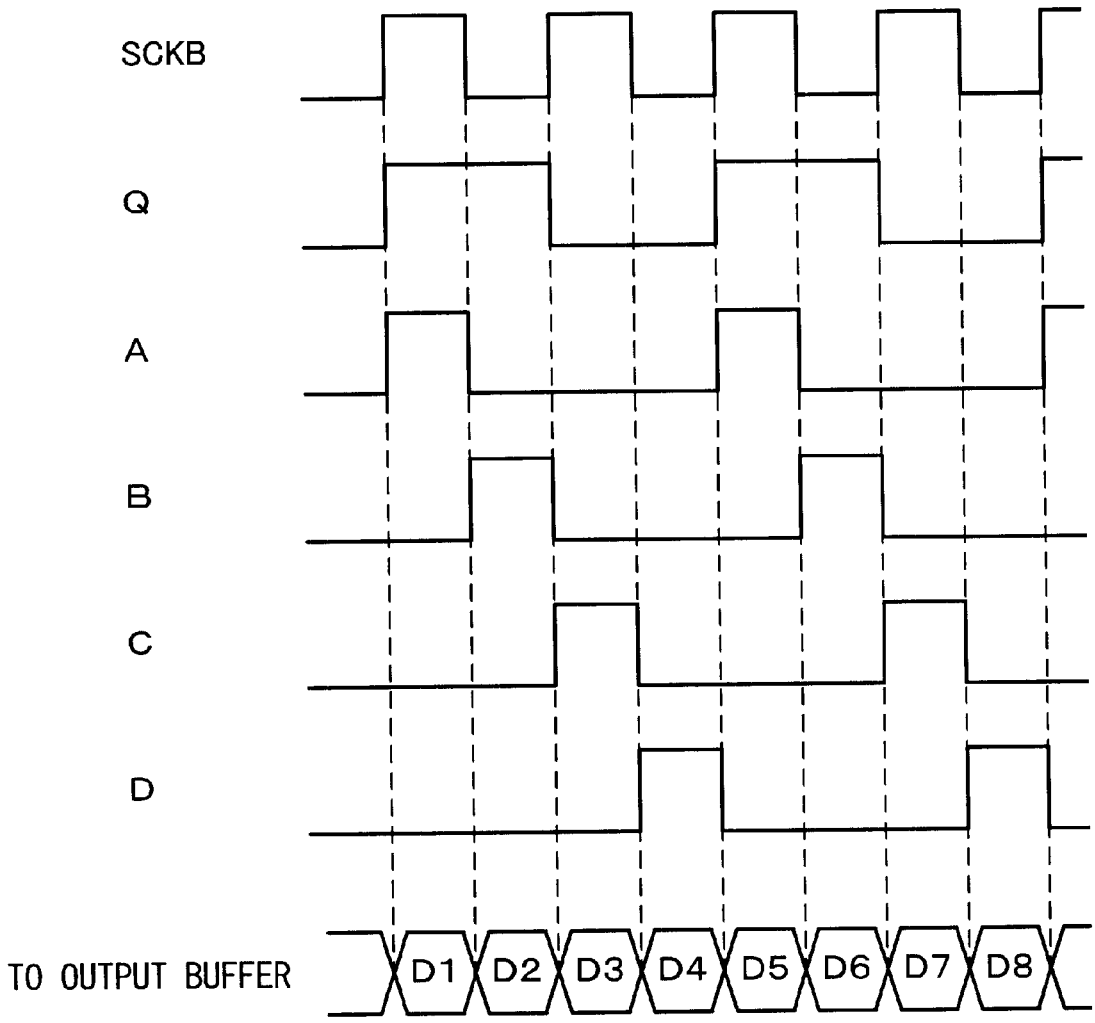
FIG. 14 is a timing chart of signals in the data output control circuit.

Then, as illustrated in FIG. 14, the control signals A, B, C and D are produced in synchronism with the edges (the leading edge and trailing edge) of the synchronizing clock signal SCKB so that the control signals successively change to high level in the order A→B→C→D→A→B→ . . . , thereby converting the display data D as parallel data back into the original time series one-channel serial data, i.e., synthesizing the serial data.

Incidentally, the structure of the data output control circuit 25 is not particularly limited to the above-described circuit structure. For instance, the transmission gate 25*c* may be a MOS transistor or other analog switch circuit. As shown in FIG. 11, the synchronizing clock signal SCKB and the transfer-use clock signal SCKA are inverted by the output inversion buffers 22 and 23 and then output to the source driver S(n+1) of the next stage [see FIG. 12(*j*) and FIG. 12(*k*)].

Thus, by inverting the clock signals and outputting the resultant signals to the next stage, the timing (phases) of the display data D, synchronizing clock signal SCKB and transfer-use clock signal SCKA at the input stage of the next stage S(n+1) can be made the same as the input stage of the source driver S(n).

More specifically, even when the high-speed display data D is input to the data latch output circuit 24 through the output buffers 18 to 20 and the input buffers 13 to 15 of the next stage, the setup time and hold time necessary for the data latch output circuit 24 to latch the display data D are ensured. This means that there will be no problem even when the source drivers 1 are connected in cascade over a number of stages to transfer the high-speed display data D.

Figure 15:
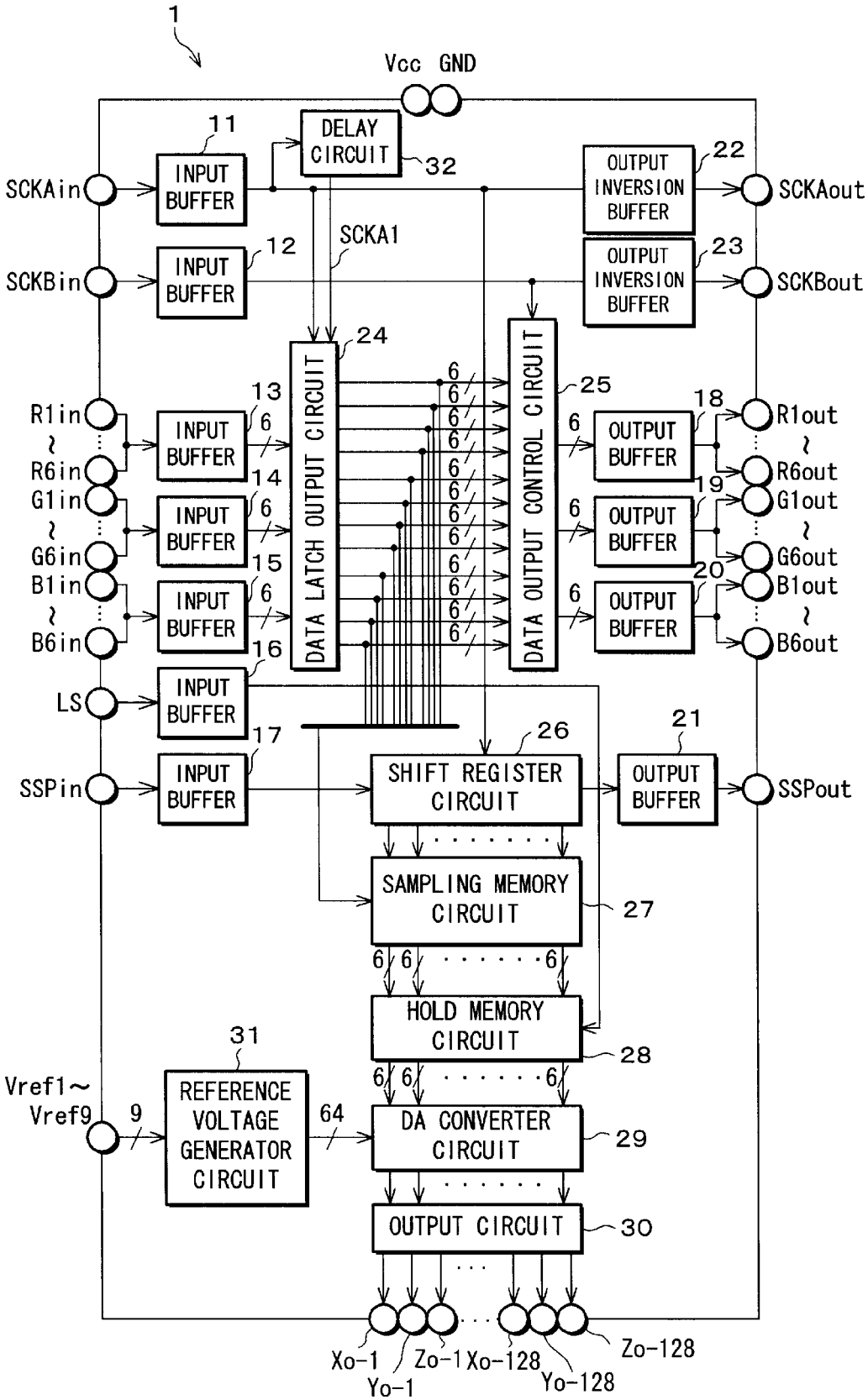
FIG. 15 is a block diagram of the source driver.

In FIGS. 11 and 13, the circuits such as the input buffers and output buffers whose explanation is unnecessary are omitted. The depiction of the system structure (the liquid crystal display device module) in which the source drivers 1 formed according to Embodiment 3 are incorporated into TCPs 3, connected in cascade and mounted on the liquid crystal display panel 4 is the same as that shown in FIG. 2. The signals output from the controller circuit 6 are the same as those shown in FIG. 3. FIG. 15 shows a block diagram of the circuit structure of the source driver 1 formed according to Embodiment 3. Although there are four lines between the data latch output circuit 24 and the sampling memory circuit 27 for each of the display-use data signals R, G and B, these lines are shown as one line in FIG. 15 as they would be undistinguishable in the drawing.

Embodiment 4

Referring now to FIG. 16 to FIG. 19, the following description will explain yet another embodiment of the present invention. In Embodiment 4, the generation of the transfer-use clock signal SCKA by dividing the synchronizing clock signal SCKB and the delay of the signal which are performed, for example, in the external controller circuit 6 in Embodiment 3 are carried out in the source driver 1. With this structure, the line between the controller circuit 6 and the source driver of the first stage, the line between the respective source drivers 1 and the lines on the TCPs 3 can be reduced.

This structure can reduce the influences of noise, etc. caused by the roundness due to the line capacity and the effect of coupling between the high-speed clock signal lines, thereby realizing a higher data transfer rate.

Figure 16:
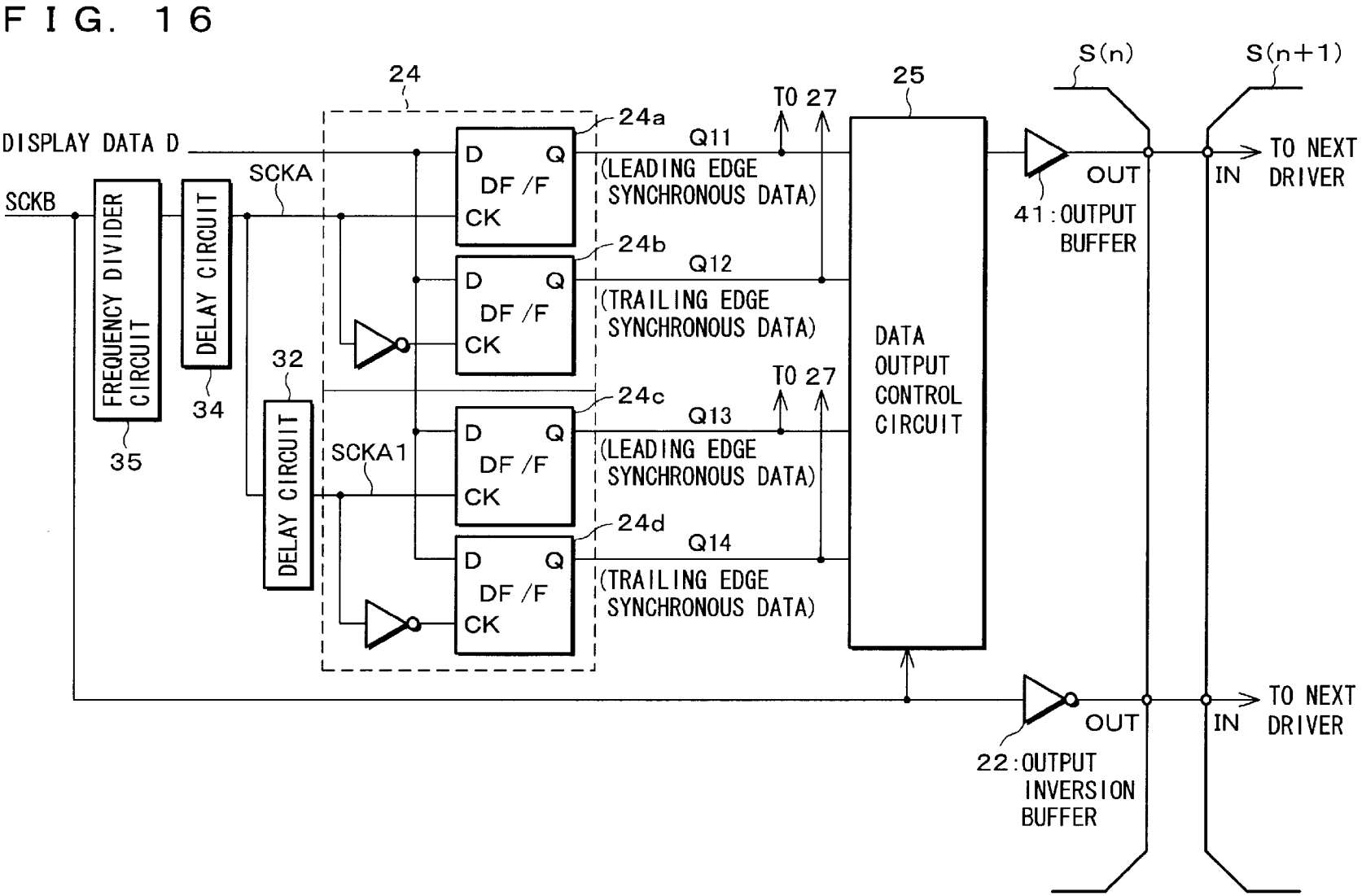
FIG. 16 is a block diagram of essential sections in the source driver according to Embodiment 4 of the present invention.

In Embodiment 4, as shown in FIG. 16, the output signal produced by dividing the synchronizing clock signal SCKB into two signals with a frequency divider circuit 35 is used as the transfer-use clock signal SCKA. For instance, the frequency divider circuit 35 may be the frequency divider circuit 33 shown in FIG. 13. More specifically, in an example of the structure of the frequency divider circuit 35, the input terminal D of the DF/F is connected to the output terminal /Q and the synchronizing clock-signal SCKB is input to the clock input terminal CK. In such a frequency divider circuit 35, an output signal produced by dividing the synchronizing clock signal SCKB into two signals is output from the output terminal Q in synchronism with the rise of the synchronizing clock signal SCKB to be input to the clock input terminal CK.

This output signal is input to the next delay circuit 34 (which may be the delay circuit 32 shown in FIG. 11) and delayed from the synchronizing clock signal SCKB by an amount of ¼ phase so as to produce the transfer-use clock signal SCKA. Furthermore, the transfer-use clock signal SCKA1 is produced by inputting the transfer-use clock signal SCKA to the above-described delay circuit 32 to introduce a delay of ¼ phase.

The detail explanation of the timing of the signals thereafter will be omitted as the structure and operation are the same as those shown in FIG. 12 except that the output of the transfer-use clock signal SCKA [see FIG. 12(*k*)] is omitted.

Figure 17:
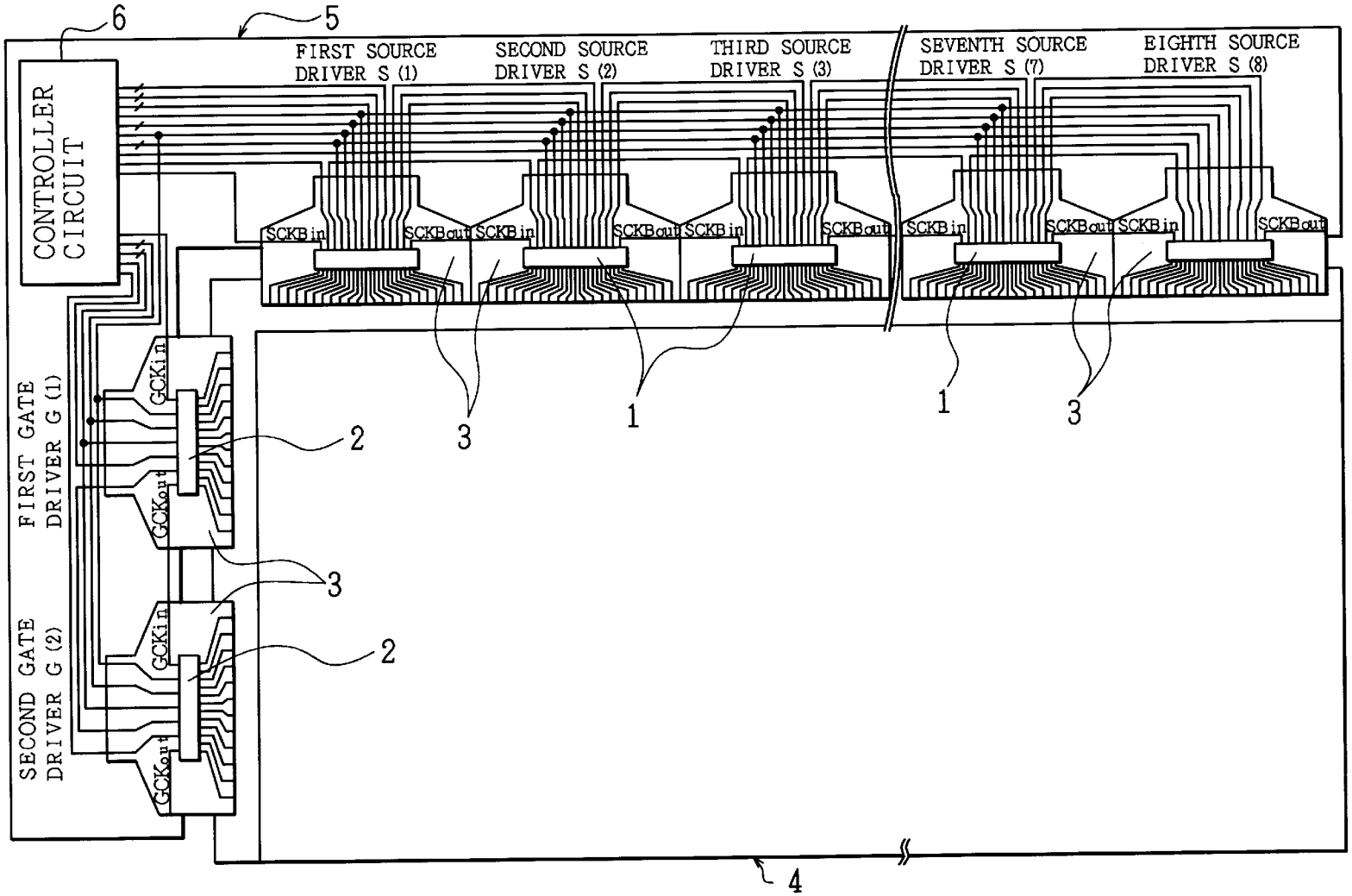
FIG. 17 is a plan view of a liquid crystal display device module including the source driver.
Figure 18:
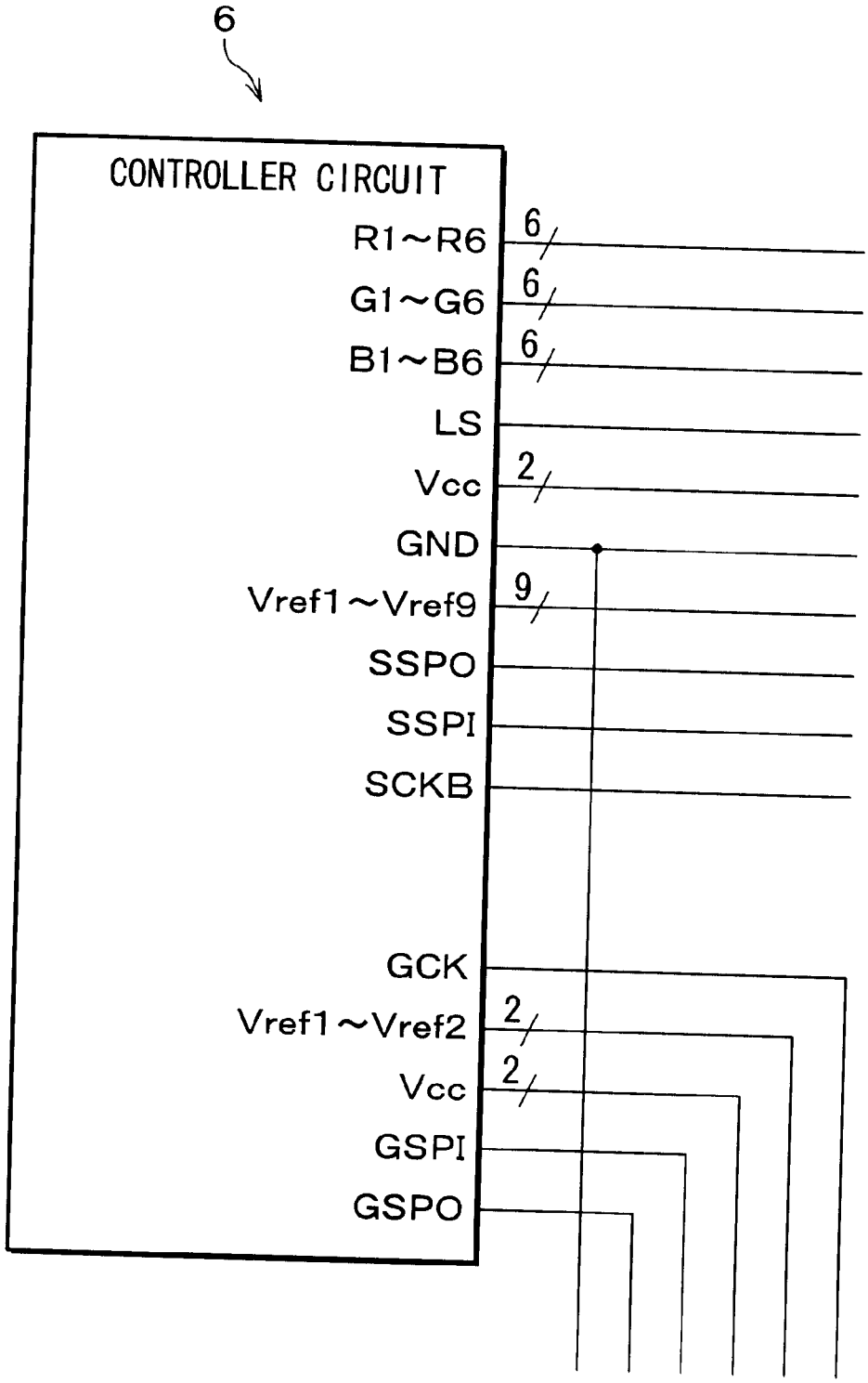
FIG. 18 is an explanatory view of the terminals of a controller circuit of the source driver.
Figure 19:
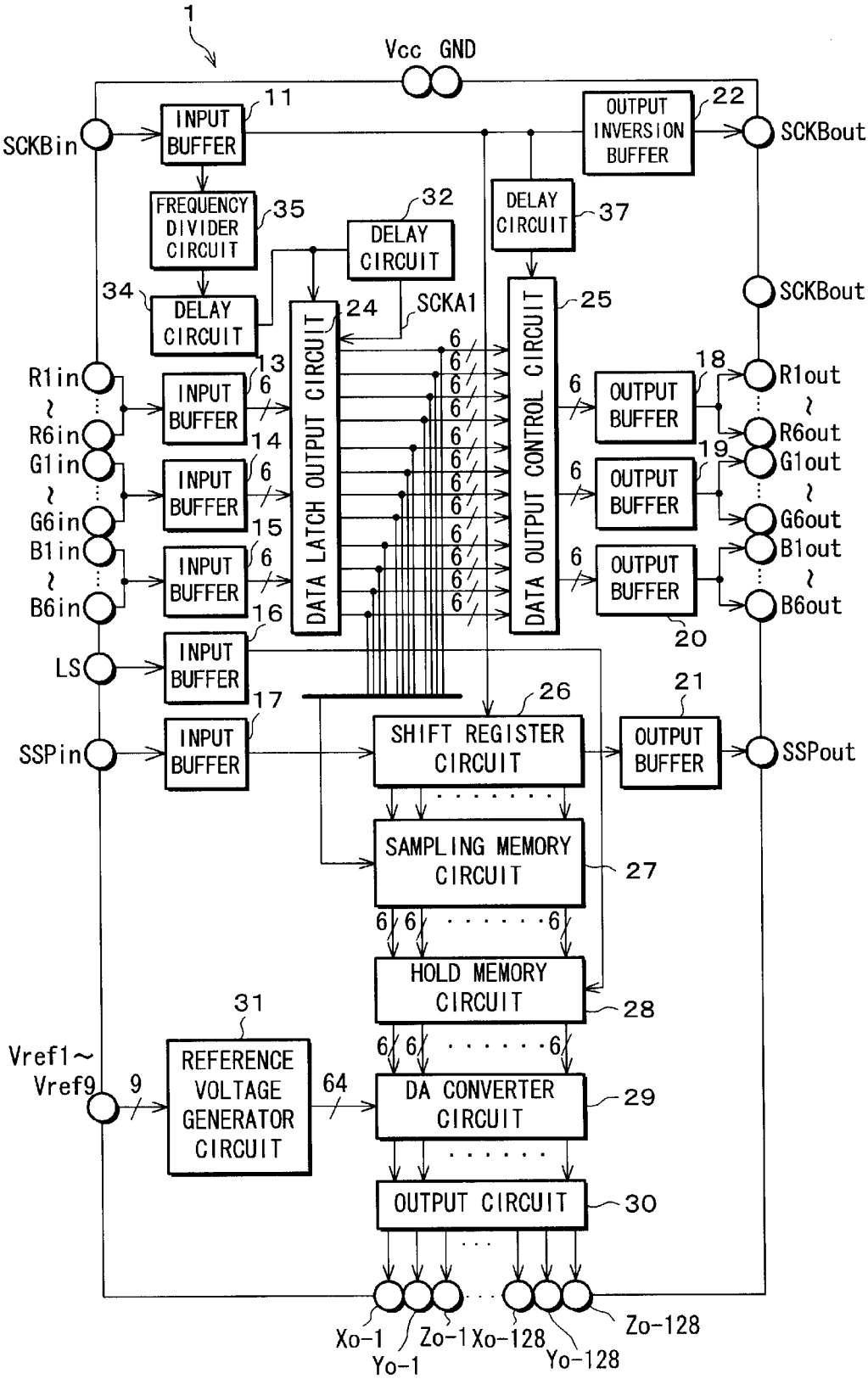
FIG. 19 is a block diagram of essential sections in the source driver.
Figure 20:
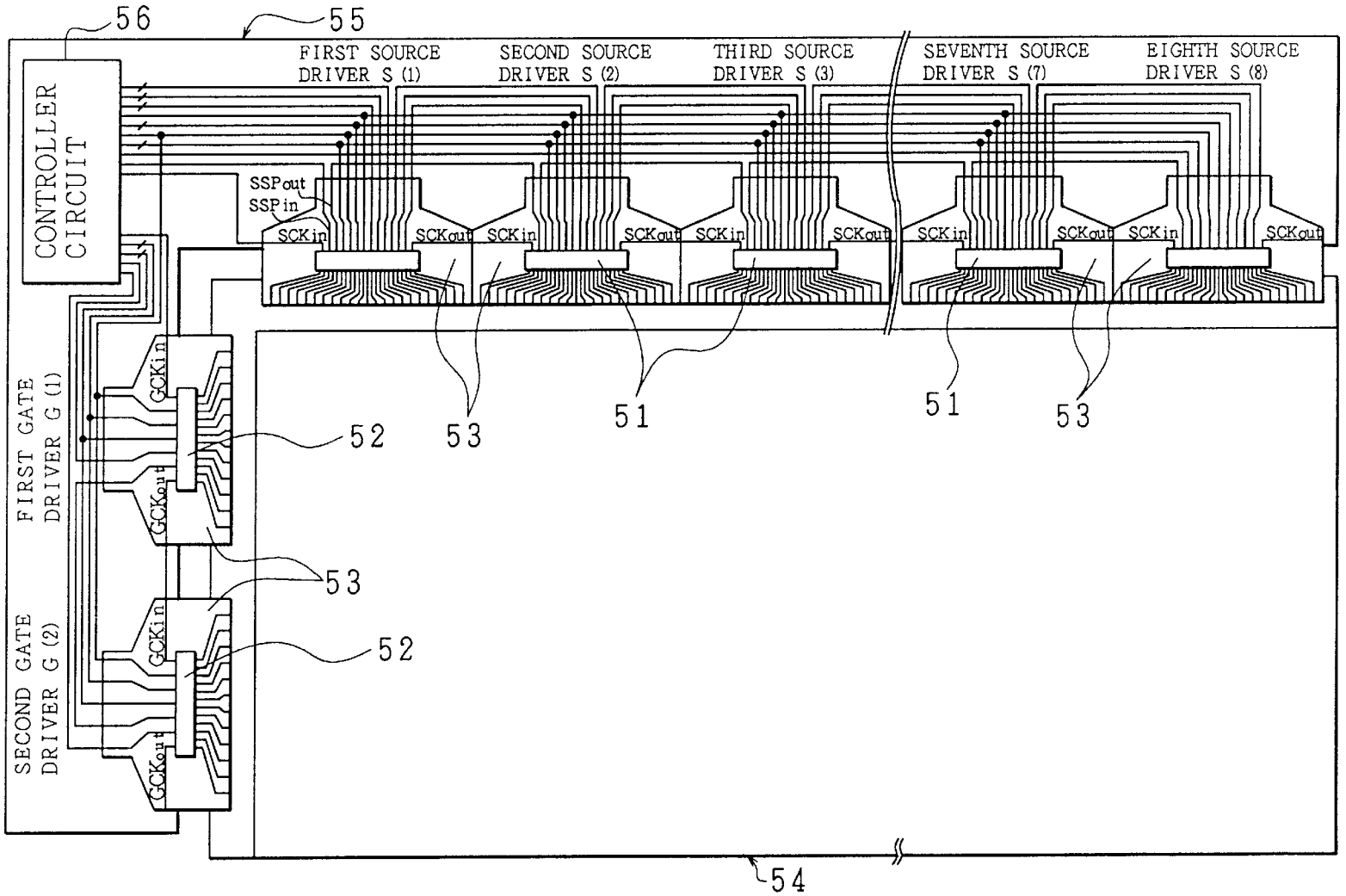
FIG. 20 PRIOR ART
FIG. 20 is a plan view of a conventional liquid crystal display device module.
Figure 21:
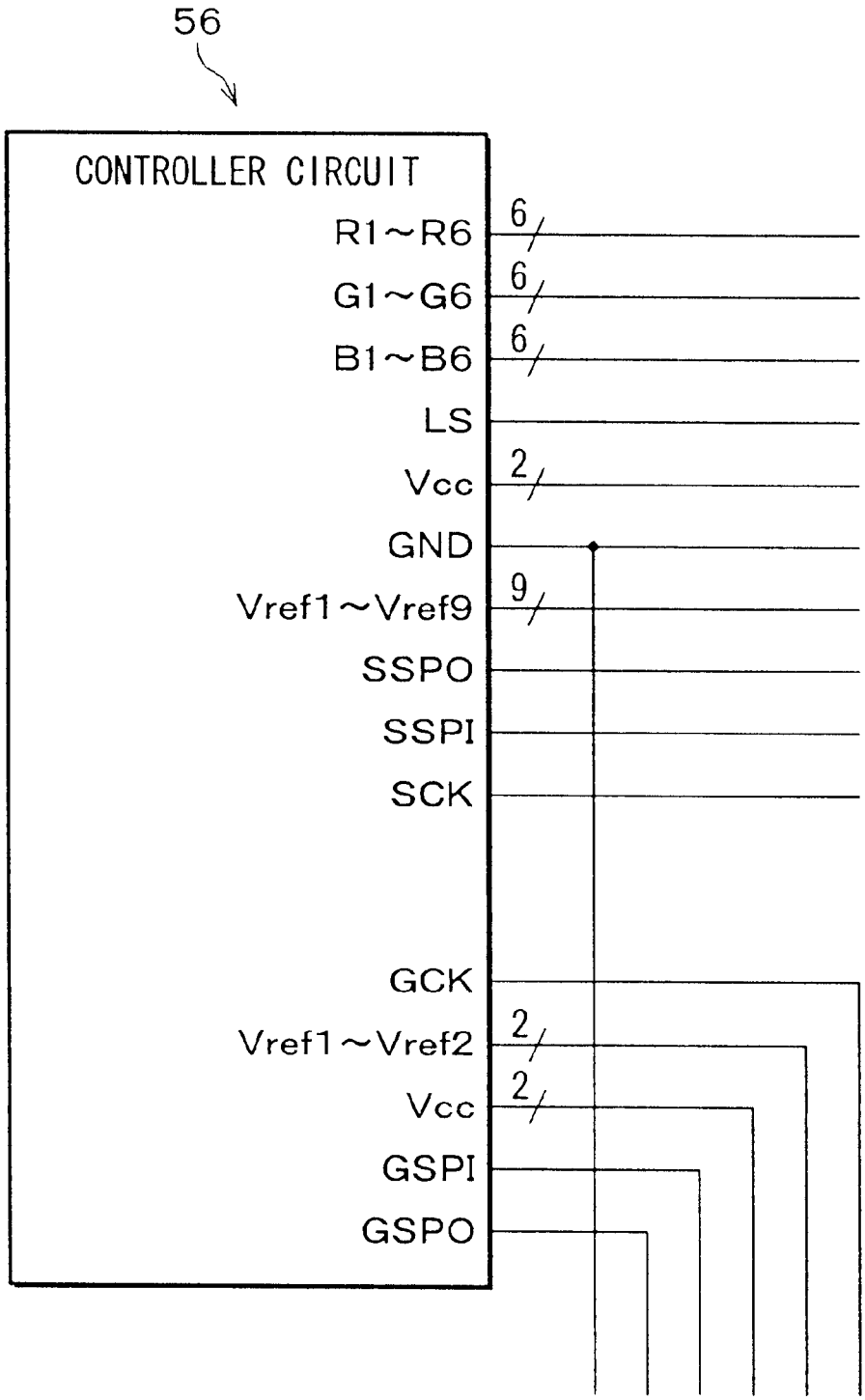
FIG. 21 PRIOR ART
FIG. 21 is an explanatory view of the terminals of a controller circuit of a source driver used in the liquid crystal display device module.

FIG. 17 shows the depiction of the system structure (the liquid crystal display device module) in which the source drivers 1 formed according to Embodiment 4 are incorporated into TCPs 3, connected in cascade and mounted on the liquid crystal display panel 4. In order to clearly illustrate each line shown in FIG. 17, the signals output from the controller circuit 6 are shown in FIG. 18. FIG. 19 shows a block diagram of the circuit structure of the source driver 1 formed according to Embodiment 4.

Embodiments 1 to 4 described above illustrate the structures in which the display data D is converted into parallel data by dividing the display data D into two channels or four channels. However, the present invention is not necessarily limited to such structures. In other words, in order to further reduce the clock frequency of the transfer-use clock signal SCKA, it is possible to adopt, for example, a structure in which the display data D as serial data is converted into parallel data by dividing the one-channel display data D into N channels in the data latch output circuit 24 as the input section and the clock frequency is made one Nth of the necessary data transfer rate (data frequency) of the display data D by converting again the N-channel data into the original one-channel data in the data output control circuit 25 as the output section.

Moreover, Embodiments 1 to 4 described above explain examples in which one-phase or two-phase transfer-use clock signals are used. However, the present invention can be implemented with m-phase transfer-use clock signals. In particular, when $m=2^k$ (k=1, 2, 3 . . . ), good conformity is achieved with the successive circuit structure. In this case, the phases of m clock signals are successively shifted by an amount of 1/(2m) phase. At this time, the display data D is converted into parallel data by dividing the display data D into 2m channels, thereby reducing the data transfer rate of the display data D to 1/(2m).

The above descriptions explain the present invention with the use of the liquid crystal drive device. However, the present invention is not necessarily limited to the liquid crystal drive device, and is effectively applied to a display device in which one or more display element driving semiconductor devices are connected in cascade, the start pulse input signal is transferred between the display element driving semiconductor devices in synchronism with the clock signal, the display data D is fetched by the transfer signal and latched at certain intervals to perform display, and one complete image is displayed by repeating the above process.

The present invention is particularly effective for a display device which includes a drive device in each of the X direction and the Y direction orthogonal to the X direction, transfers the start pulse input signal between the drive devices in synchronism with the clock signal, selects and fetches a video signal by time division by the transfer signal, latches the signal at a cycle of the horizontal synchronizing signal to perform display, and displays one complete image by repeating the above process.

Moreover, the present invention can readily meet a necessary high data transfer rate of the display data D to realize a large-area high-definition display, and is effective for achieving highly reliable quality of a display image by improving the quality of the display image and stabilizing the improved quality.

Furthermore, the present invention can achieve a semiconductor device which meets low voltage driving by reducing the operating frequency of the clock signal in the semiconductor device such as the source driver 1 and hence decreases the power consumption and is highly reliable because noise is decreased by the reduction of the operating frequency, and can also achieve a display device module using the semiconductor device.

Besides, Embodiments 1 to 4 described above explain a structure in which a semiconductor device having a chip such as the source driver 1 incorporated on the TCP 3 is mounted on the electrode (ITO line) of the liquid crystal panel 4 by, for example, thermo-compression bonding through an anisotropic conductive film (ACF). However, in the present invention, the semiconductor device may be mounted with the controller circuit 6 attached to an insulating film including a flexible substrate, a film, etc. instead of the TCP.

Moreover, the present invention can be implemented by a chip-on-glass (COG) method in which the semiconductor device is directly mounted as a chip on the electrode (ITO line) of the liquid crystal panel 4 by, for example, thermo-compression molding through an anisotropic conductive film (ACF), or by a circuit-in-glass (CIG) method in which a circuit is formed on a glass substrate of the liquid crystal panel 4 by a low-temperature polysilicon technique.

In order to achieve the above-mentioned object, the semiconductor device of the present invention is a semiconductor device including a plurality of semiconductor processing sections connected in cascade and a self-transfer system in which a plurality of signals input to the semiconductor processing section of the first stage is successively transferred through the semiconductor processing section to other semiconductor processing section, and the input section of each of the semiconductor processing sections may be provided with dividing means for converting the display-use data signals of serial data to be transferred by the self-transfer system into parallel data by dividing the serial data of one channel into N (N is a natural number) channels by using both of the leading and trailing edges of the clock signal as data fetching timing and the output section of each of the semiconductor devices may be provided with synthesizing means for synthesizing the original one-channel serial data from the display-use data signals converted into the N-channel parallel data by dividing. In this semiconductor device, N is preferably 2 or 4 to facilitate the fabrication of the semiconductor processing section.

According to this structure, one channel of the display-use data signal is converted into parallel data for display by fetching the display-use data signal at both of the leading and trailing edges of the clock signal to divide it into, for example, two channels or four channels by the dividing means provided in the input section, and the divided data is converted again into the original one-channel serial data, i.e., the serial data is synthesized by the synthesizing means, and then output.

With this structure, therefore, the frequency of the transfer-use clock signal can be reduced to 1/N of the data transfer rate (the data frequency) of the display-use data signal, for example, to a half for two channels, and the transfer timing of the display-use data signals to be successively transferred to the semiconductor processing section of the next stage can be controlled, for example, delayed by the synthesizing means and hence the specifications (data setup/hold time) for the data fetching timing of the display-use data signal in each semiconductor processing section can be easily ensured.

As a result, according to this structure, for example, even when the semiconductor device is incorporated as a drive device for a liquid crystal display device into a liquid crystal display device module and the data frequency of the display-use data signal is increased to achieve a high-definition liquid crystal display device module, the duty ratio of the transfer-use clock signal can be ensured in each semiconductor processing section without causing problems and the specifications for the data fetching timing can be easily ensured, thereby achieving highly reliable quality of the display image by the widening of the operating frequency range of the clock signal and the decrease of the operating frequency of the clock signal.

In the above semiconductor device, clock signals which are displaced in phase relative to each other are supplied to the semiconductor processing sections, and each of the clock signals may include a transfer-use clock signal used in the dividing means and a synchronizing clock signal used to synthesize the one-channel display-use data signal by the synthesizing means. In this semiconductor device, when N is 2, it is preferable that the synchronizing clock signal is a signal delayed from the transfer-use clock signal by an amount of ¼ cycle.

According to this structure, a synchronizing clock signal which is, for example, delayed from the transfer-use clock signals by an amount of ¼ cycle and has a phase different from the transfer-use clock signal can be separately used as the clock signal for converting the display-use data signals back into one channel by the synthesizing means. Therefore, even when the necessary data frequency for the display-use data signals is further increased and the transfer is likely to delay due to the influences of the line capacity, etc., the display-use data signals can be output timely to the semiconductor processing section of the next stage by considering such a delay, and the specifications for the data fetching timing in the semiconductor processing sections can be ensured more certainly in each stage.

In the above semiconductor device, the semiconductor processing section may be provided with a synchronizing clock signal generator circuit for generating a synchronizing clock signal used to synthesize the one-channel display-use data signal by the synthesizing means by shifting the phase according to the clock signal.

In this semiconductor device, the semiconductor processing section may be provided with delay means for generating m phases (m is a natural number) clock signals which are displaced in phase relative to each other and used to divide the display-use data signal by generating the clock signals from one clock signal with the introduction of delays.

In this semiconductor device, producing means for producing a plurality of clock signals used for dividing, from a synchronizing clock signal used to synthesize the original one channel from the display-use data signals divided into N channels.

According to this structure, similarly to the above structure, the specifications for the data fetching timing in the semiconductor processing sections can be more certainly ensured in each stage, and the transfer-use clock signals connected in cascade between the semiconductor processing sections can be reduced to one line, thereby reducing the influences of the line capacity and the influence of capacitive coupling between the lines of the clock signals. Moreover, it is necessary to ensure only one line of the transfer-use clock signal in the input section of each semiconductor processing section, thereby simplifying the operating specifications with respect to the clock signal for an external transfer and significantly increasing the margin for the data frequency.

In this semiconductor device, it is preferable that the synthesizing means includes converting means for converting the display-use data signal divided into N channels into one-channel serial display-use data signal by the synchronizing clock signal used to synthesize the one-channel data from the display-use data signal divided into N channels and a control signal produced from the synchronizing clock signal.

With this structure, since the display-use data signal is converted into parallel/serial data according to the synchronizing clock signal by the converting means, the transfer of the display-use data signal between the semiconductor processing sections can be performed timely, thereby ensuring the transfer.

In this semiconductor device, the producing means may produce the m-phase (m is a natural number) transfer-use clock signals from the synchronizing clock signal used for synchronizing the display-use data signals by successively delaying the synchronizing clock signal by an amount of 1/(2m) cycle.

With this structure, as described above, highly reliable quality of the display image can be obtained by the widening of the operating frequency range of the clock signal and the decrease of the operating frequency of the clock signal, and the circuit structure can be simplified.

In this semiconductor device, the semiconductor processing section may be a drive circuit for driving the display section by the display-use data signal. With this structure, the semiconductor processing section can certainly meet a higher (faster) data frequency of the display-use data signal for achieving a high-definition display, and hence the quality of the display image of the liquid crystal display device using the display-use data signals can be improved in a more stable manner while ensuring high definition.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A semiconductor device comprising:

a plurality of semiconductor processing sections which are connected in cascade and perform data processing by a self-transfer system in which a plurality of signals input to the semiconductor processing section of the first stage are successively transferred through said semiconductor processing section to other semiconductor processing section;

dividing means, provided in an input section of each of said semiconductor processing sections, for converting serial data to be transferred into parallel data by dividing the serial data of one channel into N channels (N is a natural number) by using both of leading and trailing edges of a first clock signal as data fetching timing; and synthesizing means, provided in an output section of each of said semiconductor processing sections, for synthesizing the one-channel serial data from the divided N-channel parallel data.

2. The semiconductor device as set forth in claim 1, wherein N is 2.

3. The semiconductor device as set forth in claim 1, wherein N is 4.

4. The semiconductor device as set forth in claim 1, wherein clock signals which are displaced in phase relative to each other are supplied to said semiconductor processing sections, and each of the clock signals includes the first clock signal used by said dividing means for transfer and a second clock signal used for synchronization in synthesizing the one-channel serial data from the parallel data by said synthesizing means.

5. The semiconductor device as set forth in claim 1, wherein each of said semiconductor processing sections includes a synchronizing clock signal generator circuit for producing a second clock signal, which is used for synchronization in synthesizing the one-channel serial data from the parallel data by said synthesizing means, from the first clock signal by shifting the phase.

6. The semiconductor device as set forth in claim 4, wherein the second clock signal is a signal delayed from the first clock signal by an amount of ¼ cycle.

7. The semiconductor device as set forth in claim 1, wherein each of said semiconductor processing sections includes delay means for introducing delays to produce from one clock signal m-phase (m is a natural number) clock signals which are displaced in phase relative to each other and used to convert serial data into parallel data by dividing.

8. The semiconductor device as set forth in claim 1, wherein said synthesizing means includes converting means for converting the parallel data of N channels into one-channel serial data by a second clock signal which is used for synchronization in synthesizing a one channel from the parallel data divided into N channels, and a control signal which is produced from the second clock signal.

9. The semiconductor device as set forth in claim 1, further comprising producing means for producing a plurality of third clock signals for division, from a second clock signal used to synthesize the one channel serial data from the divided N-channel parallel data.

10. The semiconductor device as set forth in claim 9, wherein said producing means produces the third clock signals of m phases (m is a natural number) from the first clock signal by successively delaying the first clock signal by an amount of 1/(2m) cycle.

11. The semiconductor device as set forth in claim 1, wherein each of said semiconductor processing sections is a drive circuit for driving a display section by the parallel data.

12. The semiconductor device as set forth in claim 1, wherein the serial data is display-use data signals for transfer.

13. The semiconductor device as set forth in claim 1, wherein the parallel data is display-use data signals for driving a display section.

14. The semiconductor device as set forth in claim 1, wherein a clock frequency of the first clock signal is 1/N of a data transfer rate of the serial data.

15. A display device module comprising:

a semiconductor device according to claim 1; and a display section driven by said semiconductor device.

16. The display device module as set forth in claim 15, wherein said display section is a liquid crystal display section.

17. The semiconductor device as set forth in claim 1, further comprising:

a first inverter, which inverts and outputs the first clock signal to another semiconductor processing section.

18. The semiconductor device as set forth in claim 4, further comprising:

a second inverter, which inverts and outputs the second clock signal to another semiconductor processing section.

* * * * *